US010627736B2

(12) United States Patent
Kawasaki

(10) Patent No.: US 10,627,736 B2
(45) Date of Patent: Apr. 21, 2020

(54) IMAGE FORMING APPARATUS AND IMAGE FORMING METHOD CAPABLE OF CORRECTING AC VOLTAGE OF CHARGING BIAS

(71) Applicant: Koichi Kawasaki, Kanagawa (JP)

(72) Inventor: Koichi Kawasaki, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 16/391,789

(22) Filed: Apr. 23, 2019

(65) Prior Publication Data

US 2019/0346789 A1 Nov. 14, 2019

(30) Foreign Application Priority Data

May 8, 2018 (JP) ..... 2018-089897

(51) Int. Cl.
*G03G 15/02* (2006.01)
*G03G 15/00* (2006.01)

(52) U.S. Cl.
CPC ..... *G03G 15/0266* (2013.01)

(58) Field of Classification Search
CPC ..... G03G 15/0266
See application file for complete search history.

(56) References Cited

U.S. PATENT DOCUMENTS 8,249,476 B2 * 8/2012 Okumura ..... G03G 15/0266 399/50
2015/0093137 A1 * 4/2015 Minanni ..... G03G 15/80 399/89

FOREIGN PATENT DOCUMENTS

| | | |
|---|---|---|
| JP | 2004-117956 | 4/2004 |
| JP | 2011-008033 | 1/2011 |
| JP | 2015-092219 | 5/2015 |

* cited by examiner

*Primary Examiner* — G. M. A Hyder
(74) *Attorney, Agent, or Firm* — IPUSA, PLLC

(57) ABSTRACT

An image forming apparatus includes an image bearer, a charger, and a power source to apply to the charger a charging bias obtained by superimposing an AC voltage on a DC voltage. The power source includes a peak detection circuit to detect positive and negative peak values of a voltage of an AC component of the charging bias; and control circuitry to compare an absolute value of the positive peak value with an absolute value of the negative peak value, correct the AC voltage to cause the absolute value of the negative peak value to coincide with the absolute value of the positive peak value when the absolute value of the positive peak value is smaller, and to cause the absolute value of the positive peak value to coincide with the absolute value of the negative peak value when the absolute value of the negative peak value is smaller.

15 Claims, 15 Drawing Sheets

IMAGE FORMING APPARATUS AND IMAGE FORMING METHOD CAPABLE OF CORRECTING AC VOLTAGE OF CHARGING BIAS

CROSS-REFERENCE TO RELATED APPLICATION

This patent application is based on and claims priority pursuant to 35 U.S.C. § 119(a) to Japanese Patent Application No. 2018-089897, filed on May 8, 2018, in the Japan Patent Office, the entire disclosure of which is hereby incorporated by reference herein.

BACKGROUND

Technical Field

Aspects of the present disclosure relate to an image forming apparatus and an image forming method.

Related Art

In an electrophotographic image forming apparatus, as a voltage application method for a charger that charges an image bearer, there has been known an AC charging method for applying, to the charger, a charging bias obtained by superimposing an alternating current (AC) voltage controlled with a constant current on a direct current (DC) voltage controlled with a constant voltage. According to an AC charging method, positive discharge and negative discharge are alternately generated between the charger and the image bearer, whereby a surface of the image bearer is uniformly charged at a desired potential.

However, in the AC charging method, distortion may occur in the AC voltage of the charging bias due to load variation caused by discharge from the charger to the image bearer. The distortion of the AC voltage varies the surface potential of the image bearer and degrades the quality of an image to be formed.

On the other hand, there has been proposed a technique of suppressing distortion of the AC voltage of the charging bias and stabilizing the surface potential of the image bearer by correcting the AC voltage waveform so as to approach the ideal waveform on the basis of a comparison between the ideal waveform and the detected AC voltage waveform.

SUMMARY

In an aspect of the present disclosure, there is provided an image forming apparatus includes an image bearer, a charger, and a power source. The charger is configured to charge the image bearer. The power source is configured to apply to the charger a charging bias obtained by superimposing an alternating current (AC) voltage on a direct current (DC) voltage. The power source includes a peak detection circuit configured to detect a positive peak value and a negative peak value of a voltage of an AC component of the charging bias and control circuitry configured to control the AC voltage. The control circuitry is configured to compare an absolute value of the positive peak value with an absolute value of the negative peak value, correct the AC voltage to cause the absolute value of the negative peak value to coincide with the absolute value of the positive peak value when the absolute value of the positive peak value is smaller than the absolute value of the negative peak value, and correct the AC voltage to cause the absolute value of the positive peak value to coincide with the absolute value of the negative peak value when the absolute value of the negative peak value is smaller than the absolute value of the positive peak value.

In still another aspect of the present disclosure, there is provided an image forming apparatus that includes an image bearer, a charger, and a power source. The charger is configured to charge the image bearer. The power source is configured to apply to the charger a charging bias obtained by superimposing an alternating current (AC) voltage on a direct current (DC) voltage. The power source includes peak detection means for detecting a positive peak value and a negative peak value of a voltage of an AC component of the charging bias and control means for controlling the AC voltage. The control means includes comparison means for comparing an absolute value of the positive peak value with an absolute value of the negative peak value; and correction means for correcting the AC voltage to cause the absolute value of the negative peak value to coincide with the absolute value of the positive peak value when the absolute value of the positive peak value is smaller than the absolute value of the negative peak value, and correcting the AC voltage to cause the absolute value of the positive peak value to coincide with the absolute value of the negative peak value when the absolute value of the negative peak value is smaller than the absolute value of the positive peak value.

In still another aspect of the present disclosure, there is provided an image forming method to be executed by an image forming apparatus comprising an image bearer, a charger configured to charge the image bearer, and a power source configured to apply to the charger a charging bias obtained by superimposing an alternating current (AC) voltage on a direct current (DC) voltage. The image forming method includes: detecting a positive peak value and a negative peak value of a voltage of an AC component of the charging bias; comparing an absolute value of the positive peak value with an absolute value of the negative peak value; correcting the AC voltage to cause the absolute value of the negative peak value to coincide with the absolute value of the positive peak value when the absolute value of the positive peak value is smaller than the absolute value of the negative peak value; and correcting the AC voltage to cause the absolute value of the positive peak value to coincide with the absolute value of the negative peak value when the absolute value of the negative peak value is smaller than the absolute value of the positive peak value.

BRIEF DESCRIPTION OF THE DRAWINGS

A more complete appreciation of the disclosure and many of the attendant advantages and features thereof can be readily obtained and understood from the following detailed description with reference to the accompanying drawings, wherein.

Figure 1:
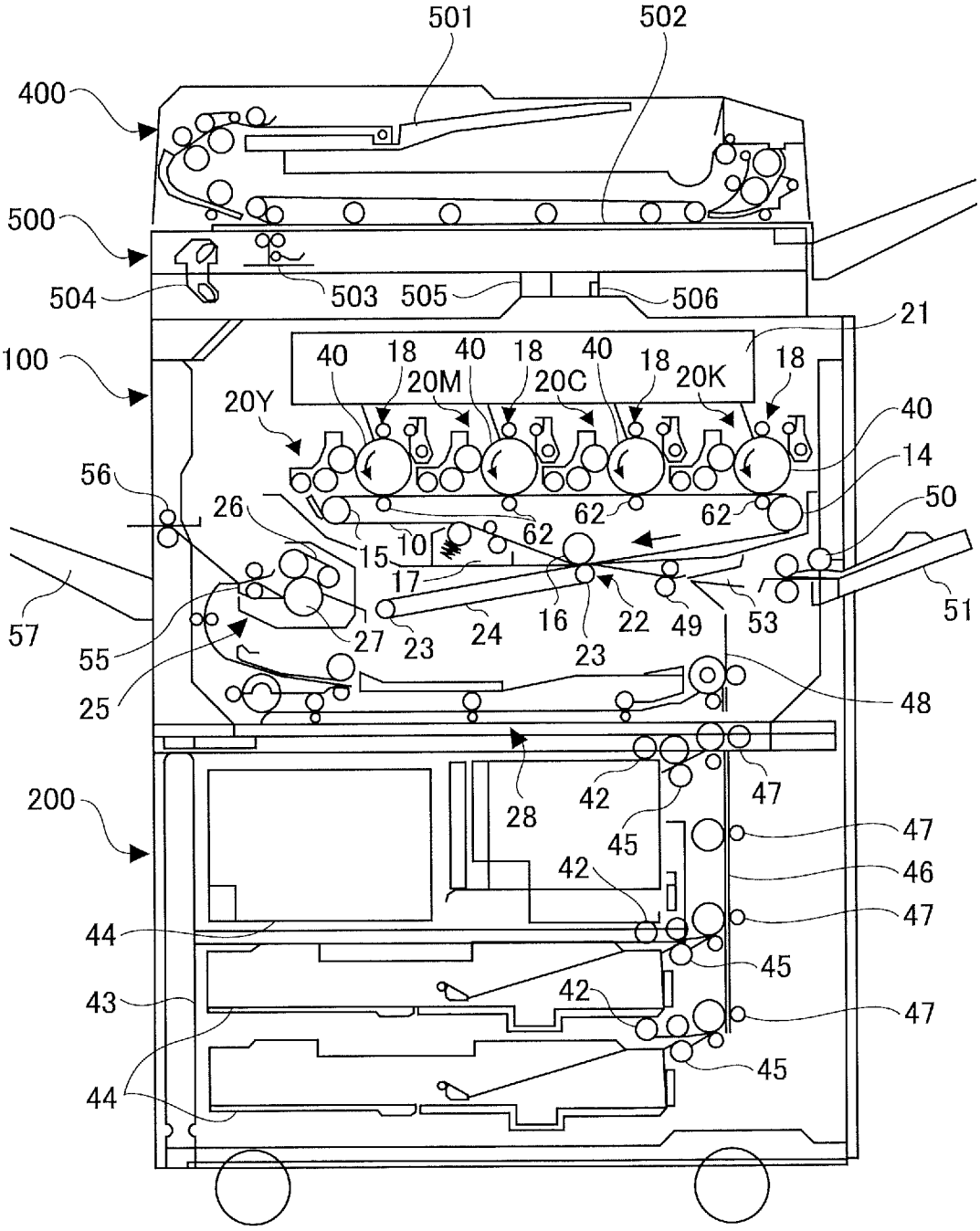
FIG. 1 is a view illustrating an example of a configuration of an image forming apparatus according to a first embodiment.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

The terminology used herein is for the purpose of describing particular embodiments only and is not intended to be limiting of the present disclosure. As used herein, the singular forms "a", "an" and "the" are intended to include the plural forms as well, unless the context clearly indicates otherwise.

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

Embodiments of the present disclosure will be described below with reference to the drawings. In the drawings, the same components are denoted by the same reference numerals, and redundant description thereof may be omitted.

A recording medium in the embodiment is paper, plastic sheet, or the like. Hereinafter, a case where the recording medium is paper will be described, and the recording medium will be simply referred to as "paper". In the terms of the embodiments, image formation, recording, printing, image printing, printing operation, and the like are all synonymous.

First Embodiment

An image forming apparatus of a first embodiment will be described with reference to the drawings. An electrophotographic image forming apparatus having a secondary transfer mechanism called a tandem system will be described below as an example.

FIG. 1 is a view illustrating an example of a configuration of the image forming apparatus according to the present embodiment. As illustrated in FIG. 1, an image forming apparatus 100 includes an intermediate transfer unit, image forming devices 20 for each color, an exposure unit 21, a secondary transfer unit 22, and a fixing unit 25.

The intermediate transfer unit includes an intermediate transfer belt 10 which is an endless belt, three support rollers 14 to 16, and an intermediate transfer member cleaning unit 17. The intermediate transfer belt 10 is wrapped around the support rollers 14 to 16 and rotated clockwise. The intermediate transfer member cleaning unit 17 is provided between the second support roller 15 and the third support roller 16, and removes residual toner remaining on a surface of the intermediate transfer belt 10 after an image is transferred.

The image forming devices 20 are disposed between the first support roller 14 and the second support roller 15. The image forming devices 20 are each disposed in a transport direction of the intermediate transfer belt 10 in the order of yellow, magenta, cyan, and black.

Each of the image forming devices 20 includes, for each color, a cleaning unit, a charging roller 18, a static eliminator, a developing unit, and a photoconductor drum, and performs image formation for each color. The image forming device 20 may be detachable from the image forming apparatus 100.

The exposure unit 21 is provided above the image forming device 20. In order to form an image, the exposure unit 21 irradiates respective photoconductor drums 40 for respective colors with laser light and performs exposure.

The secondary transfer unit 22 is provided below the intermediate transfer belt 10 and has two rollers 23 and a secondary transfer belt 24. The secondary transfer belt 24 is an endless belt, hung on the two rollers 23 and rotates. The rollers 23 and the secondary transfer belt 24 are disposed so as to push up the intermediate transfer belt 10 and press the intermediate transfer belt 10 against the third support roller 16. The secondary transfer belt 24 transfers an image on the intermediate transfer belt 10 onto paper P.

The fixing unit 25 is provided on the side of the secondary transfer unit 22, and includes a fixing belt 26 and a pressure roller 27. When the paper P on which a toner image has been transferred is sent to the fixing unit 25, the fixing unit 25 fixes the toner image on the paper P. The fixing belt 26 is an endless belt, and a pressure roller 27 is disposed to press against the fixing belt 26.

A sheet reversing unit 28 is provided below the secondary transfer unit 22 and the fixing unit 25. The sheet reversing unit 28 reverses front and back surfaces of the fed paper P. The sheet reversing unit 28 is used when an image is formed on the front surface and then formed on the back surface.

An automatic document feeder (ADF) 400 conveys the paper P onto a contact glass 502 when a start button provided in an operation unit is pressed and the paper P is on a paper feeding table 501. On the other hand, when there is no sheet P on the paper feeding table 501, the automatic document feeder 400 activates an image reading unit 500 in order to read the paper P on the contact glass 502 placed by a user.

The image reading unit 500 includes a first carriage 503, a second carriage 504, an imaging forming lens 505, a charge coupled device (CCD) 506, and a light source. The image reading unit 500 drives the first carriage 503 and the second carriage 504 to read the paper P on the contact glass 502.

The light source included in the first carriage 503 emits light toward the contact glass 502. The light from the light source is reflected by the paper P on the contact glass 502, and then reflected toward the second carriage 504 by a first mirror in the first carriage 503. The reflected light from the second carriage 504 forms an image by the imaging forming lens 505 on the CCD 506 that is a reading sensor.

The image forming apparatus 100 generates image data for Y, M, C, and K, that is, for each color, on the basis of the data acquired from the CCD 506.

The image forming apparatus 100 starts the rotation of the intermediate transfer belt 10 when a start button provided in the operation unit is pressed, when an image forming instruction is given from an external device such as a personal computer (PC), or when an output instruction of a facsimile is given.

When the rotation of the intermediate transfer belt 10 is started, the image forming device 20 starts image forming processing. The paper P on which the toner image has been transferred is sent to the fixing unit 25. The toner image is fixed to the sheet P by the fixing unit 25, and an image is formed on the paper P.

A paper feeding table 200 includes a paper feeding roller 42, a paper feeding unit 43, a separation roller 45, and a conveying roller unit 48. The paper feeding unit 43 includes a plurality of paper feeding trays 44, and the conveying roller unit 48 includes a conveying roller 47.

The paper feeding table 200 selects one of the paper feeding rollers 42. The paper feeding table 200 rotates the selected paper feeding roller 42.

The paper feeding unit 43 selects one of the plurality of paper feeding trays 44 and feeds the paper P from the paper feeding tray 44. The fed paper P is separated into one sheet of paper by the separation roller 45 and conveyed to a conveying path 46. In the conveying path 46, the paper P is conveyed to the image forming apparatus 100 by the conveying roller 47.

The sheet P conveyed to the image forming apparatus 100 is conveyed to a registration roller 49 via a paper feeding path 53, abuts against the registration roller 49, and stops. Then, the sheet P is sent to the secondary transfer unit 22 at a timing when the toner image enters the secondary transfer unit 22.

The paper P may be fed from a bypass feeder 51. When the paper P is fed from the bypass feeder 51, the image forming apparatus 100 rotates a paper feeding roller 50. The paper feeding roller 50 separates one sheet of paper from a plurality of sheets of paper on the bypass feeder 51, and conveys the separated paper P to the paper feeding path 53. The paper P conveyed to the paper feeding path 53 is further conveyed to the registration roller 49. Processing after the paper P is conveyed to the registration roller 49 is the same as that in the case of conveying the paper P from the paper feeding table 200.

The paper P is discharged after the fixing unit 25 performs fixing processing. The discharged paper P is sent to a discharge roller 56 by the switching claw 55. The discharge roller 56 sends the paper P to a paper ejection tray 57 and ejects the paper P.

The switching claw 55 may convey the paper P discharged from the fixing unit 25 to the sheet reversing unit 28. The sheet reversing unit 28 reverses the front and back surfaces of the conveyed paper P. Image formation is executed on the rear surface of the reversed paper P in the same manner as the front surface, and the paper P is conveyed to the paper ejection tray 57. As described above, the image forming apparatus 100 forms an image on the paper P.

Figure 2:
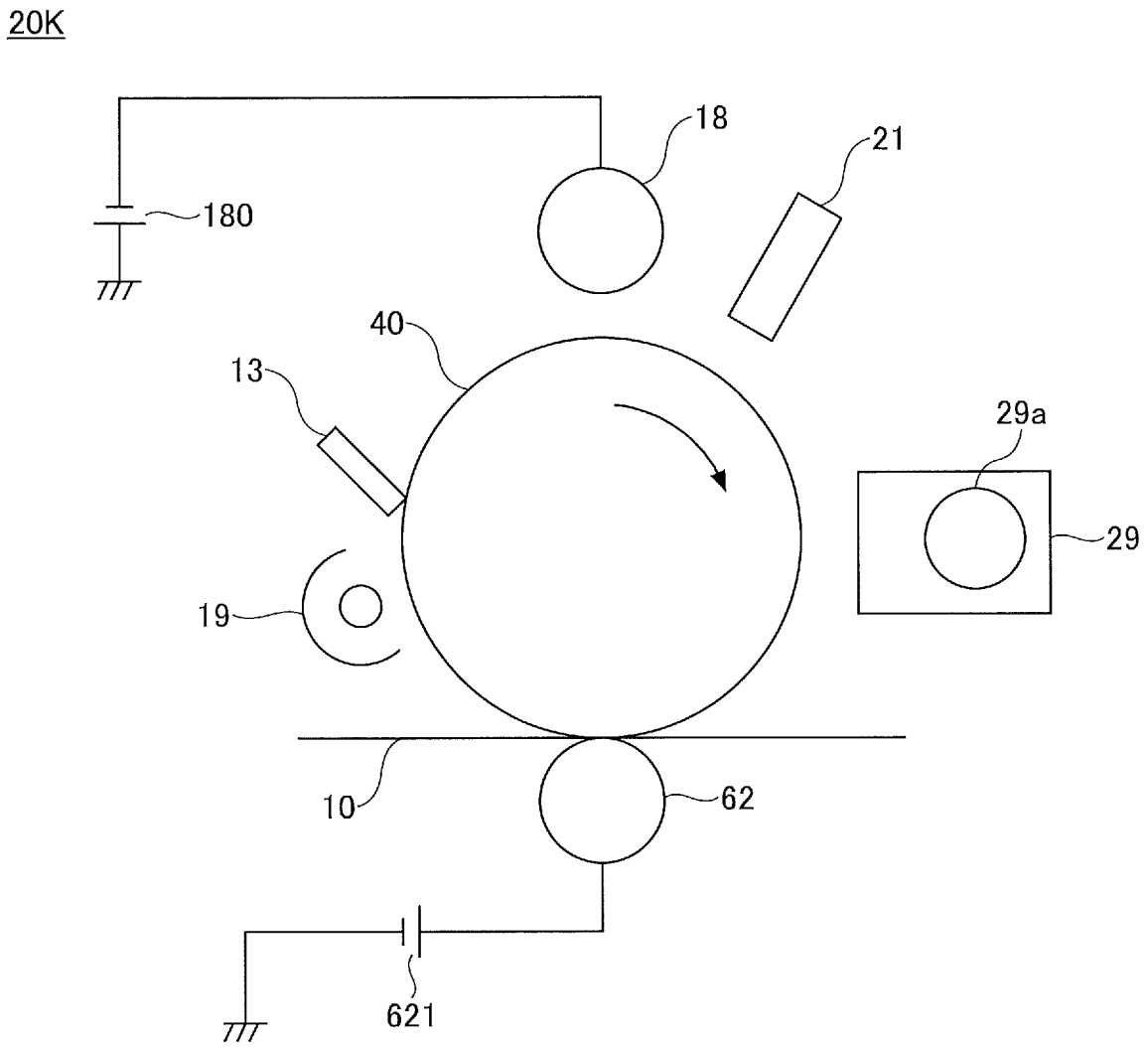
FIG. 2 is a view illustrating an example of a configuration of an image forming device included in the image forming apparatus according to the first embodiment.

Next, the image forming device 20 of the image forming apparatus 100 of the present embodiment will be described. FIG. 2 is a view explaining an example of a configuration of the image forming device 20 according to the present embodiment. FIG. 2 illustrates an example of a configuration of the image forming device 20K for black. The image forming devices 20Y, 20M, and 20C for the other three colors are configured almost in the same manner as the image forming device 20K for black except that the colors of the toner used in an image formation process are different from each other. Therefore, only the image forming device 20K for black will be described without illustration and description.

The image forming device 20K includes the photoconductor drum 40, the charging roller 18, a developing unit 29, a cleaning blade 13, and a static eliminator 19. The photoconductor drum 40 is a representative example of an "image bearer" described in the claims, and the charging roller 18 is a representative example of a "charger" described in the claims.

The photoconductor drum 40 is a negatively charged organic photosensitive member, and has a photosensitive layer or the like on a drum-shaped conductive support. In the photoconductor drum 40, an undercoat layer which is an insulating layer, a charge generation layer and a charge transport layer which are a photosensitive layer, and a surface layer such as a protective layer are sequentially laminated on a conductive support which is a base layer. For the conductive support of the photoconductor drum 40, for example, a conductive material having a volume resistance of $10^{10}$ Ωcm or less can be used.

The charging roller 18 is a roller member formed by covering an outer periphery of a conductive cored bar with an elastic layer having a medium resistance. A charging bias in which an AC voltage is superimposed on a DC voltage is applied to the charging roller 18 from the charging high-voltage power source 180, and a surface of the photoconductor drum 40 is charged, the surface facing the charging roller 18. A cleaning roller for removing dirt from the charging roller 18 may be provided in contact with the charging roller 18. The charging high-voltage power source 180 is a typical example of a "power source" described in the claims.

The developing unit 29 includes a developing roller 29*a* facing the photoconductor drum 40. The developing roller 29*a* includes a magnet that is fixedly provided inside and forms a magnetic pole on a roller peripheral surface, and a sleeve that rotates around the magnet. A plurality of magnetic poles is formed on the developing roller 29*a* by a magnet, and a developer is carried on the developing roller 29*a*.

The cleaning blade 13 mechanically scrapes off deposits such as untransferred toner adhering to the surface of the photoconductor drum 40. The cleaning blade 13 is a blade-like member made of a rubber material such as urethane rubber and formed in a substantially plate-like shape, and comes into contact with the surface of the photoconductor drum 40 at a predetermined angle and at a predetermined pressure.

The static eliminator 19 removes a charge on the surface of the photoconductor drum 40 after the toner image is transferred.

The photoconductor drum 40 charged by the charging roller 18 is exposed by the exposure unit 21 on the basis of image data. An electrostatic latent image is formed on the surface of the photoconductor drum 40. The developing unit 29 causes toner to adhere to the electrostatic latent image on the surface of the photoconductor drum 40. Thus, a toner image is developed on the surface of the photoconductor drum 40.

When a voltage generated by a transferring high-voltage power source 621 is applied to a primary transfer roller 62, the toner image on the surface of the photoconductor drum 40 is transferred to the intermediate transfer belt 10. The toner image on the intermediate transfer belt 10 is transferred to a medium by the secondary transfer unit 22, and is fixed to the medium by the fixing unit 25 (see FIG. 1). The remaining toner and the like on the surface of the photoconductor drum are removed by the cleaning blade 13. The charge on the surface of the photoconductor drum 40 is removed by the static eliminator 19.

In the case of color printing, four similar configurations are each provided for each color, a toner image is transferred to the intermediate transfer belt 10 for each color, and then a secondary transfer and a fixing process are executed.

In this embodiment, the charging roller 18 is close to the photoconductor drum 40. That is, the charging roller 18 is arranged in a non-contact state with the photoconductor drum 40. A charging method in which a minute gap (hereinafter referred to as a gap) is set between the photoconductor drum 40 and the charging roller 18 is called a non-contact charging method. According to this method, the following effects can be obtained. That is, in the non-contact charging method, as compared with a contact charging method in which the photoconductor drum 40 and the charging roller 18 are brought into contact with each other, foreign matters such as toner and lubricant remaining on the photoconductor drum 40 are less likely to adhere to the charging roller 18. Therefore, it is possible to suppress uneven charging due to adhesion of foreign matter. However, the present embodiment is not limited to the non-contact charging method and may be a contact charging method.

Figure 3:
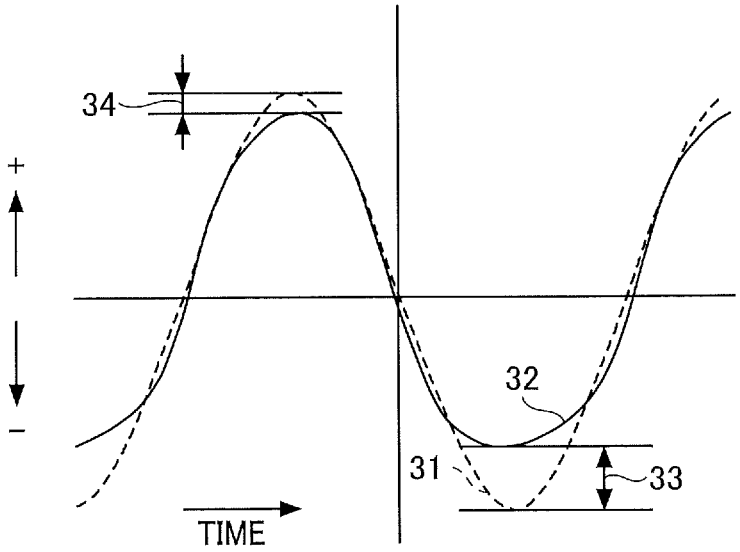
FIG. 3 is a view illustrating distortion of an AC voltage waveform.

Distortion of the AC voltage of the charging bias applied from the charging roller 18 to the photoconductor drum 40 will be described. FIG. 3 is a view illustrating distortion of an AC voltage waveform. In FIG. 3, a horizontal axis represents time, and a vertical axis represents an AC voltage of the charging bias. An upper side is a positive side and a lower side is a negative side across the horizontal axis.

An ideal waveform 31 indicated by a broken line is an AC voltage waveform that changes in a sinusoidal manner and is an ideal AC voltage waveform without distortion. On the other hand, an actual waveform 32 indicated by a solid line is an AC voltage waveform having distortion.

In an AC charging method, the surface of the photoconductor drum 40 is charged by discharging electricity from the charging roller 18 to the photoconductor drum 40. When a discharge occurs between the charging roller 18 and the photoconductor drum 40, distortion occurs in the AC voltage waveform due to a rapid load variation, and the actual waveform 32 has a smaller amplitude than the ideal waveform 31. The magnitude of this distortion depends on a charge transfer amount due to discharge. Since the discharge occurs on both positive and negative polarities, the distortion of the AC voltage waveform occurs on both positive and negative sides.

On the surface of the photoconductor drum 40, a difference between the charge transfer amount of the positive discharge and the charge transfer amount of the negative discharge may occur due to a charge remaining at the time of a primary transfer, and a gap variation between the photoconductor drum 40 and the charging roller 18 in the non-contact AC charging method. For example, when a surface potential of the photoconductor drum 40 is charged to the positive side, in a subsequent charging process, the negative discharge more easily occurs than the positive discharge, and the charge transfer amount in the negative discharge on the negative side correspondingly increases. As a result, as illustrated in FIG. 3, a negative distortion amount 33 of the AC voltage waveform is larger than a positive distortion amount 34.

Figure 4:
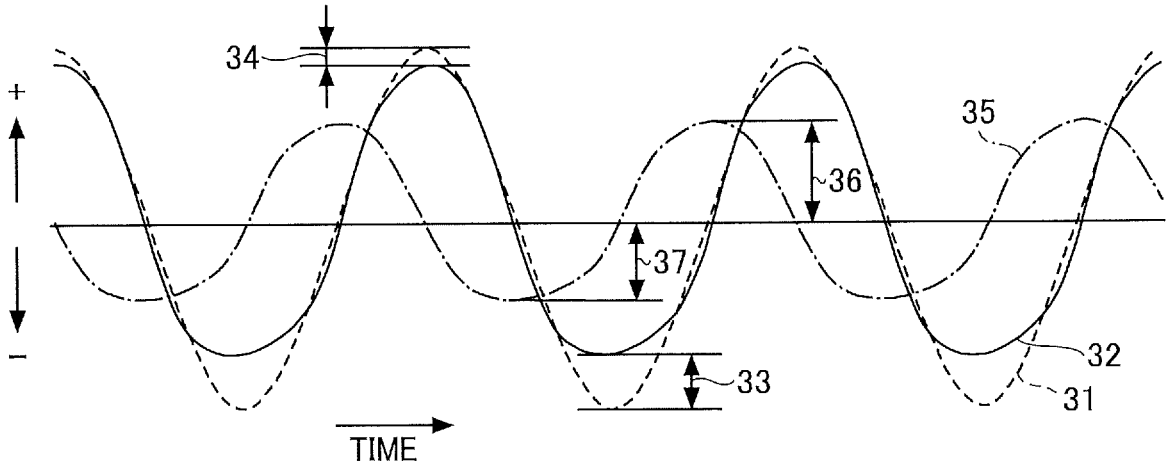
FIG. 4 is a view illustrating an AC voltage waveform and a current waveform.

FIG. 4 is a view illustrating an AC voltage waveform and a current waveform when a difference occurs between the charge transfer amount of the positive discharge and the charge transfer amount of the negative discharge. The horizontal axis represents time. An upper side is a positive side and a lower side is a negative side across the horizontal axis. Along with the ideal waveform 31 and the actual waveform 32 of the AC voltage, a current waveform 35 indicated by a one-dot chain line is illustrated. As illustrated in FIG. 4, the negative distortion amount 33 of the AC voltage waveform is larger than the positive distortion amount 34. The negative distortion amount of the current waveform 35 is larger than the positive distortion amount (an absolute value 37 of a negative current value is smaller than an absolute value 36 of a positive current value). A difference in distortion between the positive and negative sides of the AC voltage waveform and current waveform varies depending on a characteristic, variation, and a change with time of the photoconductor drum 40 and the charging roller 18.

Figure 5:
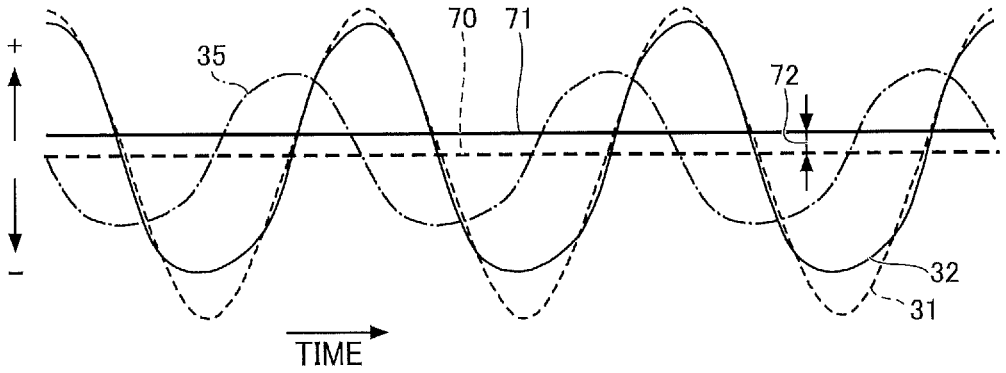
FIG. 5 is a view illustrating a surface potential of a photoconductor drum when an AC voltage is applied.

FIG. 5 is a view illustrating a surface potential of the photoconductor drum 40 when an AC voltage is applied. A horizontal axis represents time. An upper side represents a positive side, and a lower side represents a negative side across a target potential 70 indicated by a thick broken line. The ideal waveform 31 of the AC voltage, the actual waveform 32 of the AC voltage, and the current waveform 35 are illustrated. The target potential 70 indicates the surface potential of the photoconductor drum 40 when there is no distortion, and a potential 71 indicated by a thick solid line indicates the surface potential of the photoconductor drum 40 when there is distortion.

Figure 6:
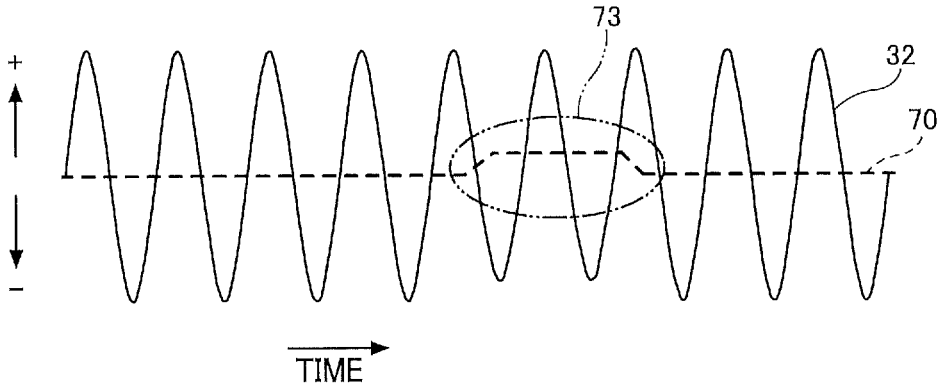
FIG. 6 is a view illustrating a time variation of the surface potential of the photoconductor drum.

In FIG. 5, in the ideal waveform 31, since the distortion amount on the positive side of the waveform of the AC voltage is equal to the amount of distortion on the negative side of the waveform of the AC voltage, the surface potential of the photoconductor drum 40 coincides with the target potential 70. On the other hand, in the actual waveform 32, the distortion amount of the waveform of the AC voltage is different between the positive side and the negative side, and an amplitude on the negative side is smaller than an amplitude on the positive side. Therefore, the surface potential of the photoconductor drum 40 is shifted in a positive direction with respect to the target potential 70. When a difference between the positive distortion amount and the negative distortion amount varies with time, the surface potential of the photoconductor drum 40 varies with time accordingly. FIG. 6 is a view illustrating a time variation of the surface potential of the photoconductor drum 40. In a region 73 indicated by a two-dot chain line, the surface potential of the photoconductor drum 40 varies in the positive direction with the difference between the positive distortion amount and the negative distortion amount.

The difference between the positive distortion amount of the AC voltage and the negative distortion amount of the AC voltage varies due to load variation when the charging bias is applied, and the surface potential of the photoconductor drum 40 varies accordingly. An image to be formed becomes thinner as the surface potential shifts in the positive direction, and becomes darker as the surface potential shifts in the negative direction. As described above, a variation in the surface potential may cause quality degradation such as density unevenness in the image to be formed.

In the case of the non-contact AC charging method, for example, a load varies due to gap variation caused by eccentricity of the photoconductor drum 40 and the charging roller 18, and the difference between the positive distortion amount of the AC voltage and the negative distortion amount of the AC voltage varies. The variation in the surface potential of the photoconductor drum 40 may cause quality deterioration such as density unevenness in an image to be formed.

Figure 7:
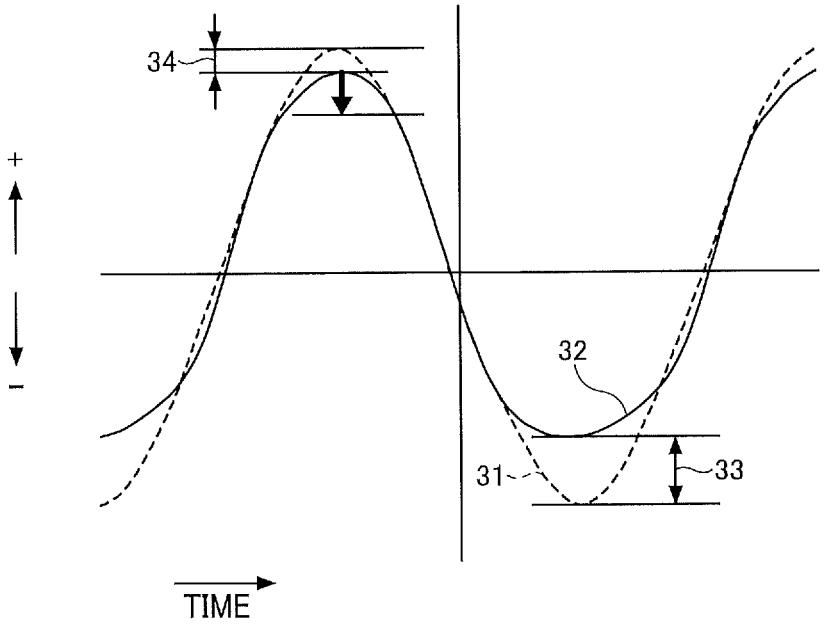
FIG. 7 is a view explaining the concept of a distortion suppression method of the AC voltage waveform according to the first embodiment.

FIG. 7 is a view explaining the concept of a distortion suppression method of the AC voltage waveform according to the present embodiment. As in FIG. 3, a horizontal axis of FIG. 7 represents time, and a vertical axis represents an AC voltage of the charging bias. An upper side is a positive side and a lower side is a negative side across the horizontal axis. In FIG. 7, the ideal waveform 31 and the actual waveform 32 are illustrated, and a difference occurs between the negative distortion amount 33 of the actual waveform 32 and the positive distortion amount 34 of the actual waveform 32. In other words, an absolute value of a negative peak value of the AC voltage is smaller than an absolute value of a positive peak value.

In the present embodiment, the absolute value of the positive peak value of the AC voltage is compared with the absolute value of the negative peak value of the AC voltage. The larger absolute value of the peak value is corrected so as to coincide with the smaller absolute value of the peak value. In the example of FIG. 7, since the absolute value of the negative peak value is smaller than the absolute value of the positive peak value, the positive output voltage is corrected in a direction indicated by a thick arrow so that the absolute value of the positive peak value and the absolute value of the negative peak value coincide with each other. Details of such correction will be described separately with reference to FIGS. 9 to 12.

Figure 8:
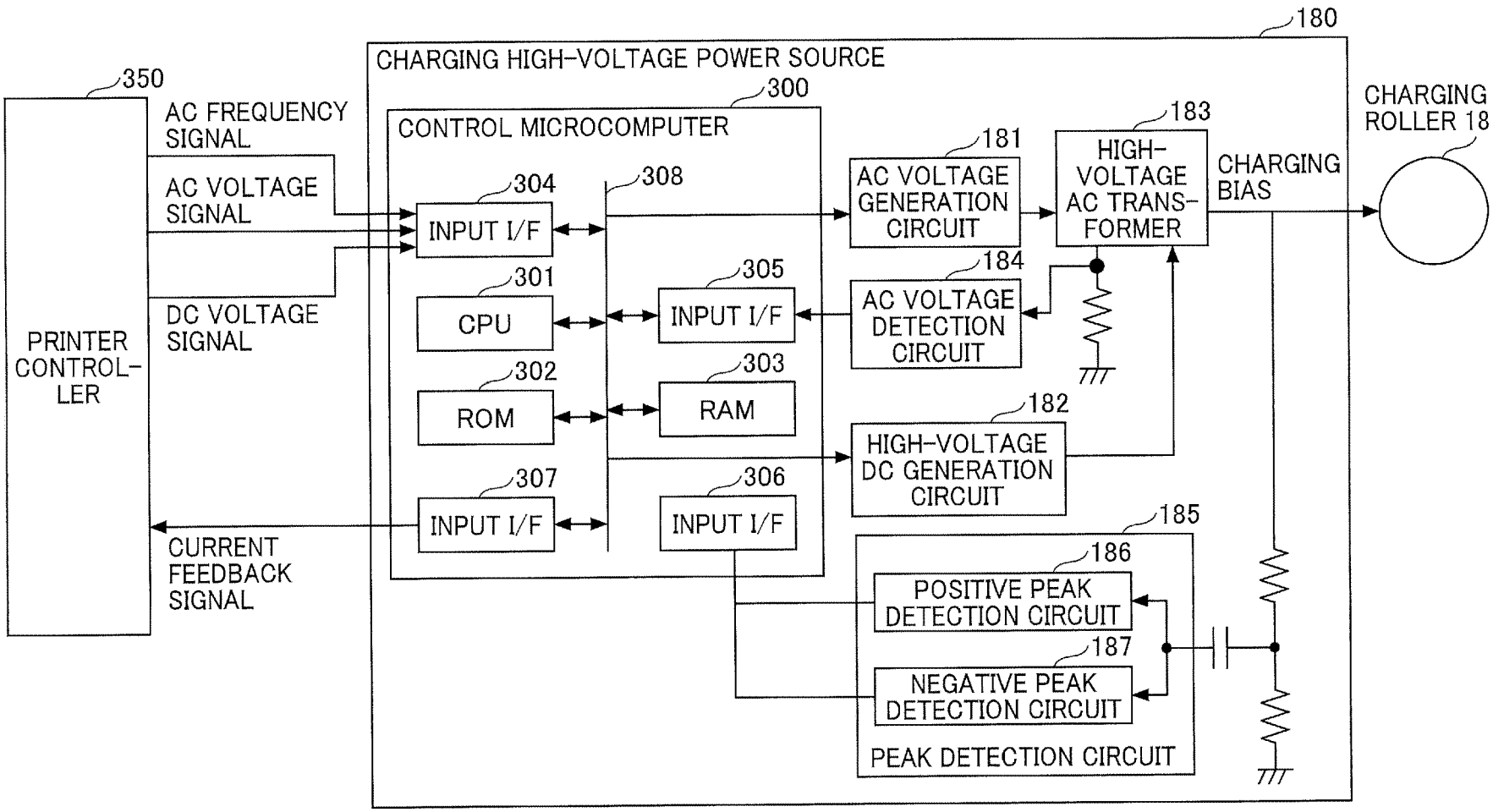
FIG. 8 is a block diagram illustrating an example of a hardware configuration of a charging high-voltage power source according to the first embodiment.

FIG. 8 is a block diagram illustrating an example of a hardware configuration of the charging high-voltage power source 180 according to the present embodiment. The charging high-voltage power source 180 includes a control microcomputer 300, an AC voltage generation circuit 181, a high-voltage DC generation circuit 182, a high-voltage AC transformer 183, an AC voltage detection circuit 184, and a peak detection circuit 185. The control microcomputer 300 is electrically connected to a printer controller 350, and receives an AC frequency signal, an AC voltage signal, and a DC voltage signal from the printer controller 350. The control microcomputer 300 transmits to the printer controller 350 a current value based on an AC voltage detected by the AC voltage detection circuit 184.

The AC voltage generation circuit 181 generates an AC voltage according to a pulse width modulation (PWM) signal, a pulse width of which is modulated, input from the control microcomputer 300 and outputs the AC voltage to the high-voltage AC transformer 183. The AC voltage generation circuit 181 includes, for example, a half bridge circuit or a full bridge circuit. The AC voltage generation circuit 181 is an example of "AC voltage generation means" described in the claims.

The high-voltage DC generation circuit 182 boosts a DC voltage input from the control microcomputer 300 by a predetermined voltage transformation ratio and outputs the DC voltage to the high-voltage AC transformer 183.

The high-voltage AC transformer 183 boosts the AC voltage input from the AC voltage generation circuit 181 by a predetermined transformation ratio. The high-voltage AC transformer 183 applies to the charging roller 18 a charging bias in which the boosted AC voltage is superimposed on the DC voltage input from the high-voltage DC generation circuit 182.

The AC voltage detection circuit 184 detects the AC voltage of the charging bias applied from the high-voltage AC transformer 183 to the charging roller 18. A signal indicating the detected AC voltage is input to the control microcomputer 300 via an input interface (I/F) 305. A signal indicating a current value based on the detected AC voltage is fed back to the printer controller 350 and used for control to obtain a desired discharge current.

The peak detection circuit 185 includes a positive peak detection circuit 186 and a negative peak detection circuit 187. A DC component is removed from the charging bias applied from the high-voltage AC transformer 183 to the charging roller 18 by a voltage dividing circuit, a capacitor, or the like, and only the AC voltage of the charging bias is input to the peak detection circuit 185. The positive peak detection circuit 186 detects a positive peak value of the input AC voltage and outputs the peak value to the control microcomputer 300. The negative peak detection circuit 187 detects a negative peak value of the input AC voltage and outputs the peak value to the control microcomputer 300.

A signal indicating the positive peak value and the negative peak value are input to the control microcomputer 300 via an input I/F 306. The signal indicating the positive peak value and the negative peak value may be converted into a digital signal by an analog/digital (A/D) conversion circuit or the like and then the converted digital signal may be input to the control microcomputer 300. The peak detection circuit 185 is an example of "peak detection means" described in the claims.

The control microcomputer 300 includes a central processing unit (CPU) 301, a read only memory (ROM) 302, a random access memory (RAM) 303, an input I/F 304, and the input I/Fs 305 and 306, and an output I/F 307. They are electrically connected to each other via a system bus 308. The control microcomputer 300 is an example of "control circuitry" or "control means" described in the claims.

The CPU 301 integrally controls the operation of the control microcomputer 300. The CPU 301 executes the program stored in the ROM 302 with the RAM 303 as a work area (work region) to control the overall operation of the control microcomputer 300, thereby realizing various functions to be described later.

The printer controller 350 controls the operation of the image forming apparatus 100. The printer controller 350 transmits to the control microcomputer 300 a signal indicating an AC frequency for controlling the charging high-voltage power source 180, a signal indicating an AC voltage value, and a signal indicating a DC voltage value. These signals are input to the control microcomputer 300 via the input I/F 304. The printer controller 350 receives a signal indicating a current value based on the AC voltage detected by the AC voltage detection circuit 184 from the control microcomputer 300 via the output I/F 307.

The control microcomputer 300 can realize a functional configuration described below by a hardware configuration illustrated in FIG. 8.

Figure 9:
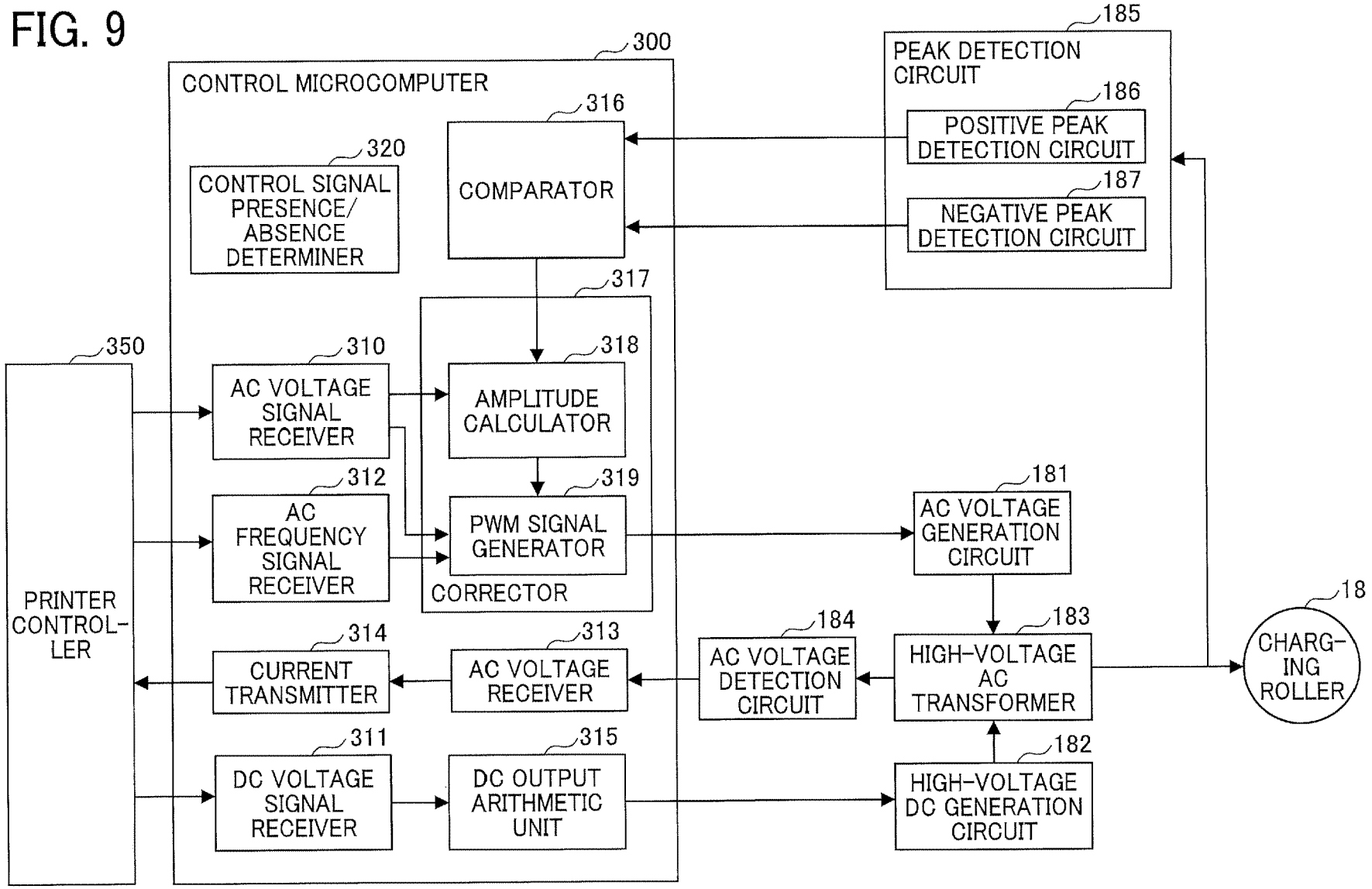
FIG. 9 is a functional block diagram illustrating an example of components of a control microcomputer according to the first embodiment.

FIG. 9 is a functional block diagram illustrating an example of components of the control microcomputer 300 according to the present embodiment. Each of the functional blocks of the control microcomputer 300 illustrated in FIG. 9 is conceptual, and does not necessarily have to be physically configured as illustrated. All or part of each functional block may be functionally or physically distributed and combined in an arbitrary unit. All or an arbitrary part of each processing function performed in each functional block of the control microcomputer 300 can be realized by a program executed by the CPU 301 described above, or can be realized as hardware by wired logic.

As illustrated in FIG. 9, the control microcomputer 300 includes an AC voltage signal receiver 310, a DC voltage signal receiver 311, an AC frequency signal receiver 312, an AC voltage receiver 313, a current transmitter 314, a DC output arithmetic unit 315, a comparator 316, a corrector 317, and a control signal presence/absence determiner 320.

The AC voltage signal receiver 310 receives a signal indicating an AC voltage value from the printer controller 350 and outputs the signal to an amplitude calculator 318 and the PWM signal generator 319. The DC voltage signal receiver 311 receives a signal indicating a DC voltage value from the printer controller 350 and outputs the signal to the DC output arithmetic unit 315. The AC frequency signal receiver 312 receives a signal indicating an AC frequency from the printer controller 350 and outputs the signal to the PWM signal generator 319.

The AC voltage receiver 313 receives a signal indicating an AC voltage value from the AC voltage detection circuit 184, and the current transmitter 314 transmits to the printer controller 350 a signal indicating a current value based on the received AC voltage.

The DC output arithmetic unit 315 performs a desired arithmetic operation or the like on the signal indicating the DC voltage value input from the DC voltage signal receiver 311, and then outputs the DC voltage to the high-voltage DC generation circuit 182.

The control signal presence/absence determiner 320 determines the presence/absence of a control signal for a signal indicating an AC frequency, a signal indicating an AC voltage value, and a signal indicating a DC voltage value, these signals being input from the printer controller 350 to the control microcomputer 300.

The comparator 316 receives a signal indicating the positive peak value of the AC voltage, the positive peak value being detected by the positive peak detection circuit 186. The comparator 316 receives a signal indicating the negative peak value of the AC voltage, the negative peak value being detected by the negative peak detection circuit 187. When a signal indicating a positive peak value and a signal indicating a negative peak value are input as analog signals, the comparator 316 A/D converts these signals into digital signals. The comparator 316 compares magnitude of the absolute value of the positive peak value with magnitude of the absolute value of the negative peak value, and outputs to the corrector 317 a magnitude comparison result, a signal indicating the positive peak value, and a signal indicating the negative peak value. The comparator 316 is an example of "comparison means" described in the claims.

The corrector 317 includes an amplitude calculator 318 and a PWM signal generator 319. The amplitude calculator 318 calculates a positive amplitude value and a negative amplitude value of a sine wave on the basis of a result obtained by comparing the magnitude of the absolute value of the positive peak value with the magnitude of the absolute value of the negative peak value, the signal indicating the positive peak value, and the signal indicating the negative peak value. When the absolute value of the positive peak value is smaller than the absolute value of the negative peak value, the negative amplitude value is calculated so as to coincide with the positive amplitude value. On the other hand, when the absolute value of the negative peak value is smaller than the absolute value of the positive peak value, the positive amplitude value is calculated so as to coincide with the negative amplitude value. The amplitude calculator 318 outputs the calculated positive and negative amplitude values to the PWM signal generator 319. Incidentally, "coincidence" in this case permits errors that are generally recognized as noise. This point is also the same in the following. The corrector 317 is an example of "correction means" described in the claims.

The PWM signal generator 319 generates a sine wave signal with the input positive and negative amplitude values, and performs comparator processing that acts in the same manner as the comparator circuit using the sine wave signal and a carrier signal as an input. The PWM signal generator 319 time-divides the sine wave signal by the comparator processing, and generates a pulse width modulation signal, that is, a PWM signal, in which the pulse width is modulated according to a voltage of the sine wave signal in each of time-divided periods. The PWM signal generator 319 outputs the generated PWM signal to the AC voltage generation circuit 181, and the AC voltage generation circuit 181 generates an AC voltage according to the PWM signal.

Figure 10:
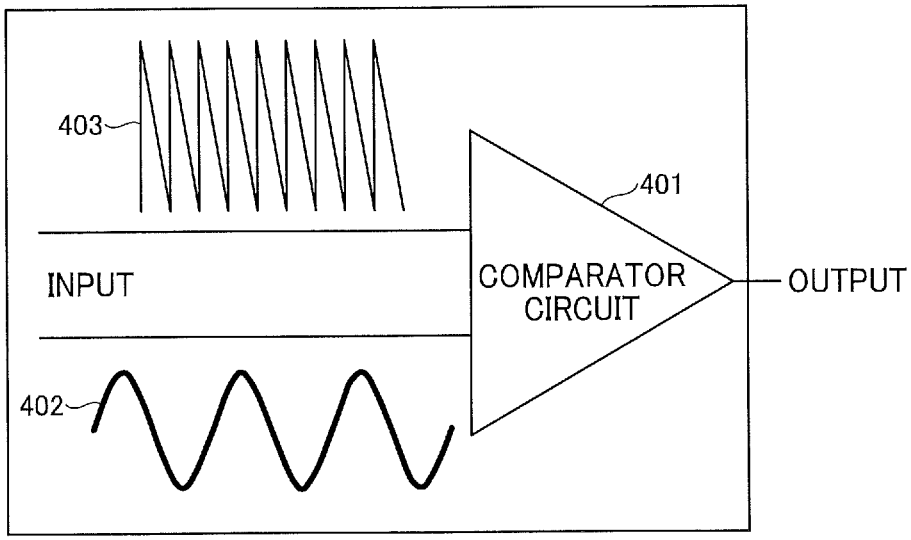
FIG. 10 is a view explaining generation processing of a PWM signal by a comparator circuit.

FIG. 10 is a view explaining generation processing of a PWM signal by the comparator circuit. As illustrated in FIG. 10, a sine wave signal 402 and a carrier signal 403 are input to the comparator circuit 401. The waveform of the carrier signal 403 is a sawtooth wave or a triangular wave. The comparator circuit 401 time-divides two input signals, compares voltage values of the two input signals for each period, and outputs the larger voltage value. As a result, a PWM signal whose pulse width is modulated every period is generated.

The PWM signal generator 319 of the present embodiment executes, on software, generating processing for a PWM signal by the above comparator circuit.

As a specific example, assume that a charging bias is generated according to a control signal indicating that positive and negative amplitude values of the AC voltage are 100, the generated charging bias is applied to the charging roller 18, and due to a discharge load, the positive peak value is distorted to 90 and the negative peak value is distorted to 80. The unit for 100, 90, and 80 is arbitrary, but is, for example, a percentage, or the like.

In such an example, the comparator 316 compares the positive peak value with the negative peak value, the positive and negative peak values being detected by the peak detection circuit 185, and determines that the absolute value of the negative peak value is smaller than the absolute value of the positive peak value. The comparator 316 outputs to the corrector 317 a signal indicating a positive peak value 90, a signal indicating a negative peak value 80, and a signal indicating a comparison result that the absolute value of the negative peak value is smaller.

In the corrector 317, the amplitude calculator 318 corrects the amplitude value indicated by the control signal so that the absolute value of the positive peak value coincides with the absolute value of the negative peak value, and calculates the positive amplitude value. In this example, the positive amplitude value is calculated as $\frac{80}{100}\times 100$ so that the distorted result is 80. On the other hand, the negative amplitude value is not corrected and remains at 100 according to the amplitude value indicated by the control signal. The amplitude calculator 318 outputs the calculated positive amplitude value and the calculated negative amplitude value to the PWM signal generator 319.

Figure 11:
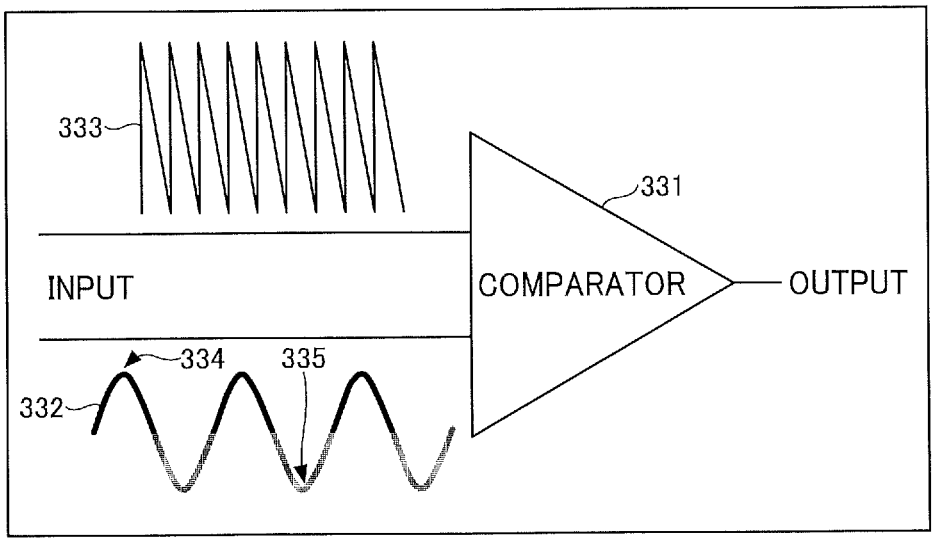
FIG. 11 is a view explaining an example of processing executed by a PWM signal generator according to the first embodiment.

The PWM signal generator 319 generates a sine wave signal according to the input positive amplitude value and the input negative amplitude value. FIG. 11 is a view explaining an example of processing executed by the PWM signal generator 319 according to the present embodiment. Reference numeral 332 indicates a generated sine wave signal, and reference numeral 333 indicates a carrier signal. In the sine wave signal 332, reference numeral 334 indicates a positive peak based on a positive amplitude value, and reference numeral 335 indicates a negative peak based on a negative amplitude value. In the sine wave signal 332, a black line portion indicates a positive voltage waveform, and a gray line portion indicates a negative voltage waveform.

The sine wave signal 332 and the carrier signal 333 are input to a comparator 331, and a PWM signal is generated and output. The AC voltage generation circuit 181 generates an AC voltage according to the generated PWM signal, and the high-voltage AC transformer 183 applies a charging bias to the charging roller 18. An AC voltage waveform is distorted by the load of discharge at a time of application, and as a result, a charging bias in which the absolute value of the positive peak value of the AC voltage is 80 and the absolute value of the negative peak value of the AC voltage is 80 is applied to the charging roller 18. By correcting the absolute value of the positive peak value so as to coincide with the smaller absolute value of the negative peak value, the absolute value of the positive peak value and the absolute value of the negative peak value can be made equal to each other by the applied charging bias. As a result, the surface potential of the photoconductor drum 40 does not vary, and the target potential is stably obtained.

In the present embodiment, as described above, since the larger absolute value of the peak value is corrected so as to coincide with the smaller absolute value of the peak value. Therefore, a discharge current may become small and an appropriate discharge current may not be obtained in some cases. In such a case, the charging bias is controlled using the current value based on the AC voltage detected by the AC voltage detection circuit 184.

The signal indicating the current value based on the AC voltage detected by the AC voltage detection circuit 184 is fed back to the printer controller 350 via the output I/F 307. The printer controller 350 calculates an AC voltage value or a DC voltage value of a charging bias so as to obtain an appropriate discharge current amount according to a signal indicating the fed back current value, and outputs a calculation result to the control microcomputer 300. A charging bias is generated and applied to the charging roller 18 according to a signal indicating the AC voltage value or the DC voltage value input via the input I/F 304. Thus, a desired discharge current can be obtained.

In the present embodiment, the function of the PWM signal generator 319 is implemented by software, but when high speed processing is required, the function of the PWM signal generator 319 may be implemented by hardware such as using a comparator electric circuit.

Figure 12:
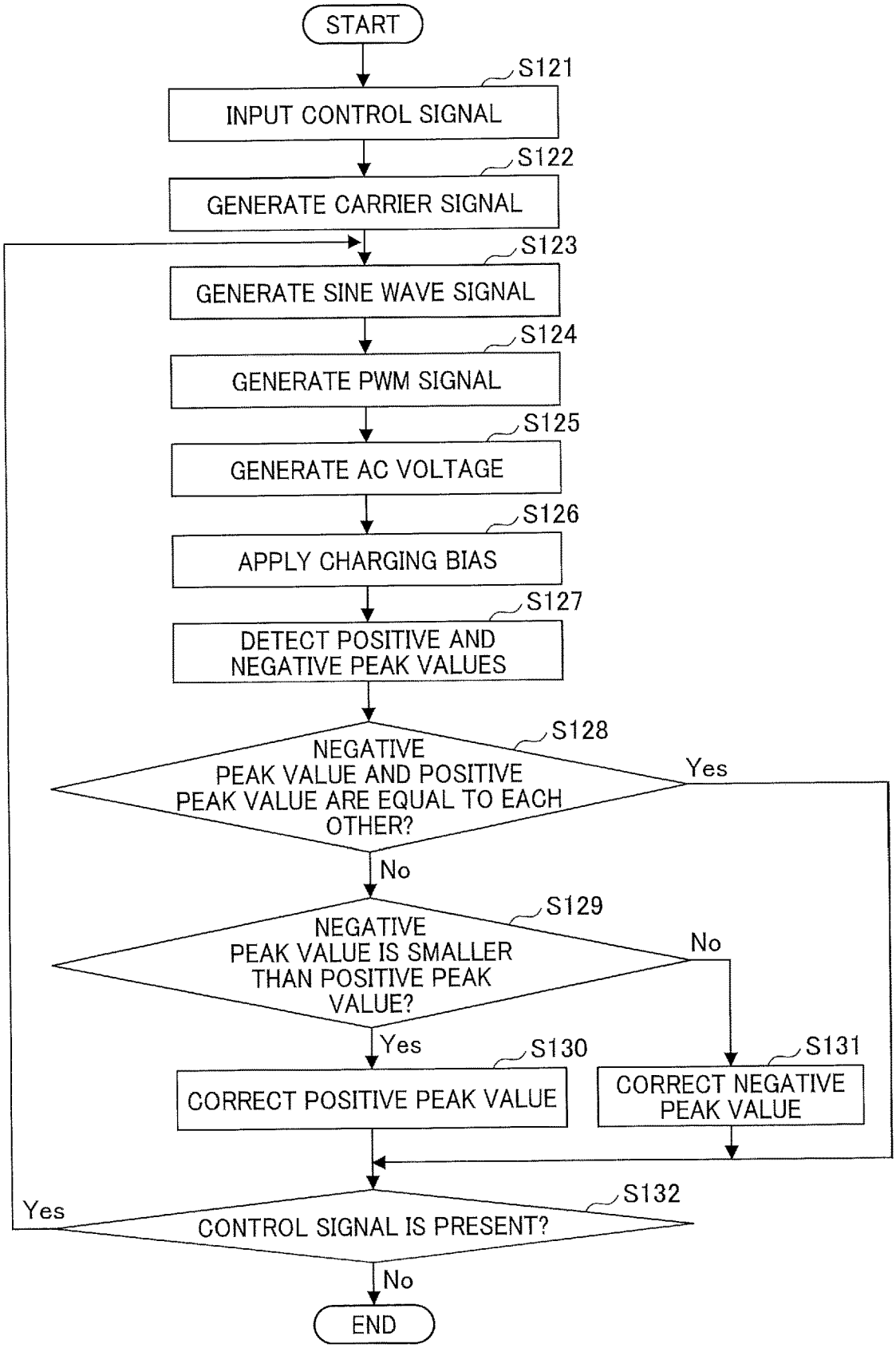
FIG. 12 is a flowchart illustrating an example of processing for applying a charging bias to a charging roller in the charging high-voltage power source according to the first embodiment.

FIG. 12 is a flowchart illustrating an example of processing for applying a charging bias to the charging roller 18 in the charging high-voltage power source 180 according to the present embodiment.

First, a signal indicating an AC voltage value, a signal indicating a DC voltage value, and a signal indicating an AC frequency are input as control signals from the printer controller 350 to the control microcomputer 300 included in the charging high-voltage power source 180 (step S121). A signal indicating the AC voltage value is input to the amplitude calculator 318 and the PWM signal generator 319 via the AC voltage signal receiver 310. The signal indicating the DC voltage value is input to the DC output arithmetic unit 315 via the DC voltage signal receiver 311. The signal indicating the AC frequency is input to the PWM signal generator 319 via the AC frequency signal receiver 312.

Next, the PWM signal generator 319 generates a carrier signal having a frequency based on the input signal indicating the AC frequency (step S122).

Next, the PWM signal generator 319 generates a sine wave signal having an amplitude and a frequency based on the signal indicating the input AC voltage value and the signal indicating the AC frequency (step S123).

Next, the PWM signal generator 319 performs comparator processing using the carrier signal and the sine wave signal as input signals, generates a pulse width modulated PWM signal, and outputs the pulse width modulated PWM signal to the AC voltage generation circuit 181 (step S124).

Next, the AC voltage generation circuit 181 generates an AC voltage according to the input PWM signal and outputs the AC voltage to the high-voltage AC transformer 183 (step S125).

On the other hand, the DC output arithmetic unit 315 performs a desired arithmetic operation or the like on the input signal indicating the DC voltage value, and then outputs the DC voltage to the high-voltage DC generation circuit 182. The high-voltage DC generation circuit boosts the input DC voltage by a predetermined voltage transformation ratio and outputs the DC voltage to the high-voltage AC transformer 183.

Next, the high-voltage AC transformer 183 boosts the input AC voltage by a predetermined transformation ratio, generates a charging bias by superimposing the boosted AC voltage on the input DC voltage, and applies the charging bias to the charging roller 18 (step S126). A DC component is removed from the charging bias by a voltage dividing circuit, a capacitor, or the like, and only the AC voltage of the charging bias is extracted. A signal indicating the extracted AC voltage is input to the peak detection circuit 185.

Next, in the peak detection circuit 185, the positive peak detection circuit 186 detects a positive peak value from the input AC voltage, and outputs a signal indicating the positive peak value to the comparator 316. The negative peak detection circuit 187 detects a negative peak value from the input AC voltage value, and outputs a signal indicating the negative peak value to the comparator 316 (step S127).

Next, the comparator 316 compares the positive peak value input from the positive peak detection circuit 186 with the negative peak value input from the negative peak detection circuit 187, and determines whether the absolute value of the input positive peak value and the absolute value of the input negative peak value are equal to each other (step S128). When the absolute value of the input positive peak value and the absolute value of the input negative peak value are equal to each other (step S128, Yes), the comparator 316 outputs to the corrector 317 a signal indicating that these absolute values are equal to each other, a signal indicating the positive peak value, and a signal indicating the negative peak value. In the corrector 317, the amplitude calculator 318 calculates a positive amplitude value and a negative amplitude value without correcting an amplitude value indicated by the control signal. Then, the processing proceeds to step S132.

When the absolute value of the input positive peak value and the absolute value of the input negative peak value are not equal to each other (step S128, No), the comparator 316 determines whether the absolute value of the negative peak value is smaller than the absolute value of the positive peak value (step S129).

When the absolute value of the input positive peak value is smaller than the absolute value of the input negative peak value (step S129, Yes), the comparator 316 outputs to the corrector 317 a signal indicating that the absolute value of the input positive peak value is smaller than the absolute value of the input negative peak value, a signal indicating the positive peak value, and a signal indicating the negative peak value. In the corrector 317, the amplitude calculator 318 corrects the amplitude value indicated by the control signal so that the absolute value of the positive peak value coincides with the smaller absolute value of the negative peak value, and calculates the positive amplitude value (step S130). The negative amplitude value is not corrected and remains at the amplitude value indicated by the control signal.

When the absolute value of the input positive peak value is larger than the absolute value of the input negative peak value (step S129, No), the comparator 316 outputs to the corrector 317 a signal indicating that the absolute value of the positive peak value is larger than the absolute value of the negative peak value, a signal indicating the positive peak value, and a signal indicating the negative peak value. In the corrector 317, the amplitude calculator 318 corrects the amplitude value indicated by the control signal so that the absolute value of the negative peak value coincides with the smaller absolute value of the positive peak value, and calculates the negative amplitude value (step S131). The positive amplitude value is not corrected and remains at the amplitude value indicated by the control signal.

Next, the control signal presence/absence determiner 320 determines the presence/absence of a control signal to be input from the printer controller 350 to the charging high-voltage power source 180 (step S132). If there is a control signal (step S132, Yes), the processing returns to step S123, and on the basis of the positive amplitude value and the negative amplitude value calculated by the amplitude calculator 318, the processing from step S123 onward is continued. On the other hand, if there is no control signal (step S132, No), the processing ends.

In this way, the charging high-voltage power source 180 can suppress distortion of the waveform of the AC voltage and apply a charging bias to the charging roller 18.

As described above, according to the present embodiment, the positive and negative peak values of the AC component of the charging bias are detected. When the absolute value of the positive peak value is smaller than the absolute value of the negative peak value, the AC voltage of the charging bias is corrected so that the absolute value of the negative peak value coincides with the absolute value of the positive peak value. When the absolute value of the negative peak value is smaller, the AC voltage of the charging bias is corrected so that the absolute value of the positive peak value coincides with the absolute value of the negative peak value.

Thus, a charging bias having the same positive and negative peak values of the AC voltage can be generated, and the surface potential of the image bearer such as the photoconductor drum 40 can be stabilized. Since the pulse width is not corrected, the surface potential of the image bearer can be stabilized without being restricted by the output capacity of a power source and without using a power source having a large output capacity.

In the present embodiment, the comparator 316 compares the absolute value of the positive peak value with the absolute value of the negative peak value, the positive and negative peak values being detected by the peak detection circuit 185, and executes processing according to the comparison result. In this case, an effective value may be used instead of the peak value. In other words, a positive effective value may be compared with a negative effective value, and the processing may be executed according to the comparison result. The effective value is a square root obtained by averaging the square of a value at each instant during one cycle. For example, the effective value is calculated as $1/\sqrt{2}$ (times) of the amplitude value of the AC voltage. By using the effective value, as compared with a case where the peak value is used, the correction accuracy can be improved because it is less susceptible to, for example, sudden noise. The other effects are the same as in the case of using the peak value.

Second Embodiment

Next, an example of an image forming apparatus according to a second embodiment will be described. In the first embodiment, description of the same components as those of the first embodiment described above may be omitted.

In this embodiment, in order to suppress an influence of distortion of a waveform of an AC voltage on the image quality, a PWM control for correcting the distortion of the AC voltage is performed by controlling a pulse width of a PWM signal under a predetermined condition.

Figure 13:
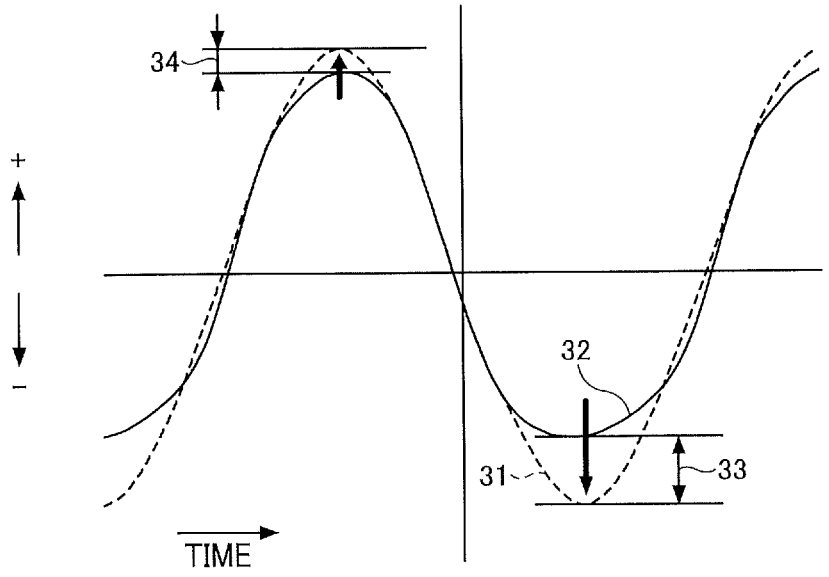
FIG. 13 is a view explaining the concept of a distortion suppression method of the AC voltage waveform by a PWM control according to a second embodiment.

FIG. 13 is a view explaining the concept of a distortion suppression method of the AC voltage waveform by the PWM control according to the present embodiment. As in FIG. 3 and the like, a horizontal axis of FIG. 13 represents time, and a vertical axis represents an AC voltage of the charging bias. An upper side is a positive side and a lower side is a negative side across the horizontal axis. In FIG. 13, the ideal waveform 31 and the actual waveform 32 are illustrated, and a difference occurs between the negative distortion amount 33 of the actual waveform 32 and the positive distortion amount 34 of the actual waveform 32.

In the PWM control, the actual waveform 32 is corrected so as to approach the ideal waveform 31. For example, as indicated by a thick arrow, the positive peak value of the actual waveform 32 is corrected so as to approach the peak value of the ideal waveform on the positive side, and the negative peak value of the actual waveform 32 is corrected so as to approach the peak value of the voltage of the ideal waveform on the negative side.

Figure 14:
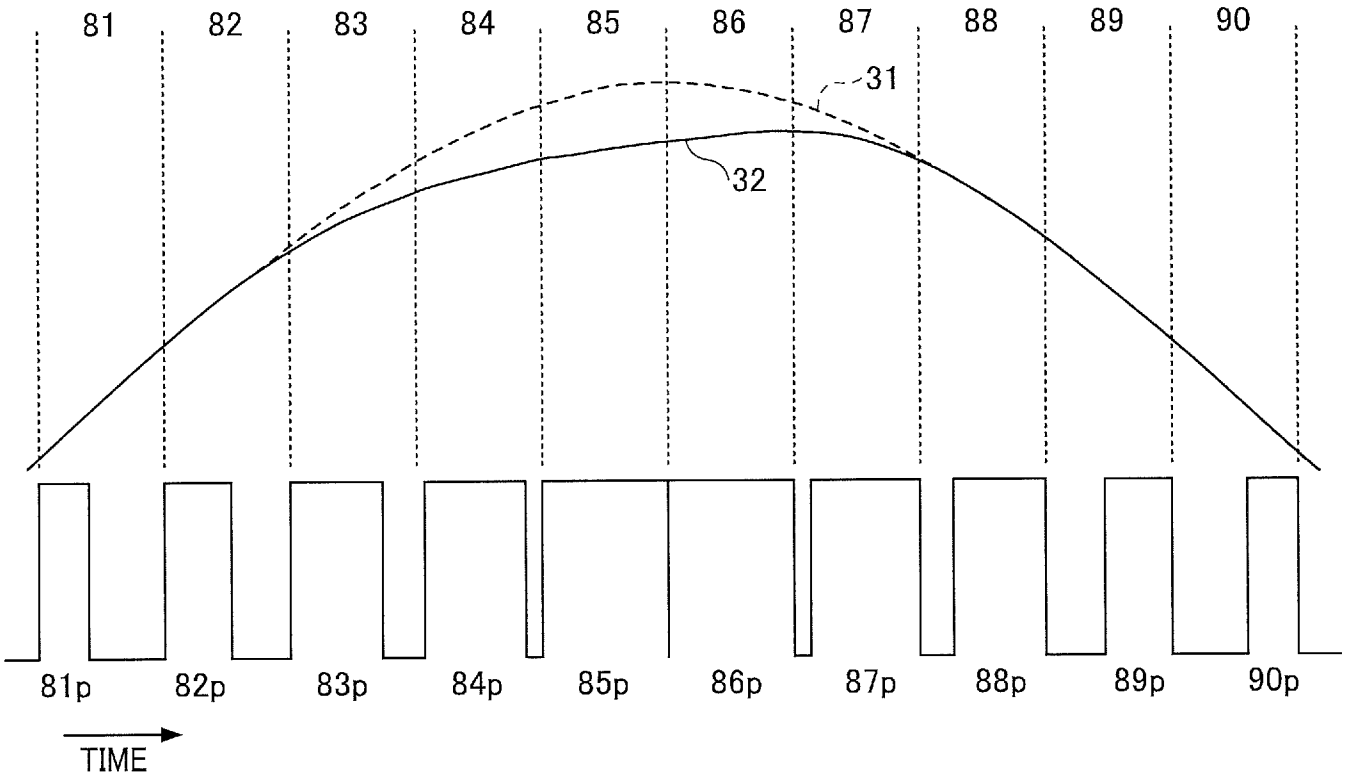
FIG. 14 is a view explaining the PWM control according to the second embodiment.

FIG. 14 is a view explaining the PWM control according to the present embodiment. The PWM control is a method of modulating a power by changing a duty ratio of a pulse wave. In FIG. 14, a horizontal axis represents time, and time regions 81 to 90 represent time-divided time regions. A pulse wave 81*p* indicates a pulse wave applied in the time region 81. Similarly, pulse waves 82*p* to 90*p* represent pulse waves applied respectively to the time regions 82 to 90. The longer a pulse width indicating ON of a voltage is, the higher an output voltage is. By changing a length of the pulse width at the duty ratio, an AC voltage having a sinusoidal voltage waveform is generated.

In the example illustrated in FIG. 14, the actual waveform 32 is distorted in the time regions 83 to 87 with respect to the ideal waveform 31 of the AC voltage. By increasing the duty ratios of the pulse waves 83*p* to 87*p* and increasing the output voltage in the time regions 83 to 87, the distortion of the actual waveform 32 can be eliminated, and the actual waveform 32 can be corrected so as to approach the ideal waveform 31. As a result, the absolute values of the positive and negative peak values of the AC voltage waveform become equal to each other, and the discharge current to the photoconductor drum 40 becomes equal, whereby the surface potential of the photoconductor drum 40 can be stabilized.

However, the duty ratio is 100% at the maximum. Therefore, if there is a large distortion that cannot be corrected unless a duty ratio exceeds 100%, the distortion cannot be corrected only by adjusting the duty ratio. That is, a desired PWM signal cannot be generated only by a pulse wave having a duty ratio less than 100%. As a countermeasure in such a case, it is conceivable to increase an output capacity of the charging high-voltage power source 180. That is, the charging high-voltage power source 180 including an output capacity such that the voltage waveform is not distorted even when the load current increases due to discharge is used. However, since a charging high-voltage power source having a large output capacity is expensive, the cost of components constituting the image forming apparatus 100 increases.

In the present embodiment, when a desired PWM signal can be generated only by a pulse wave having a duty ratio less than 100%, distortion of the AC voltage is corrected by the PWM control. When a desired PWM signal cannot be generated only by a pulse wave having the duty ratio less than 100%, distortion of the AC voltage is corrected by the method described in the first embodiment.

Figure 15:
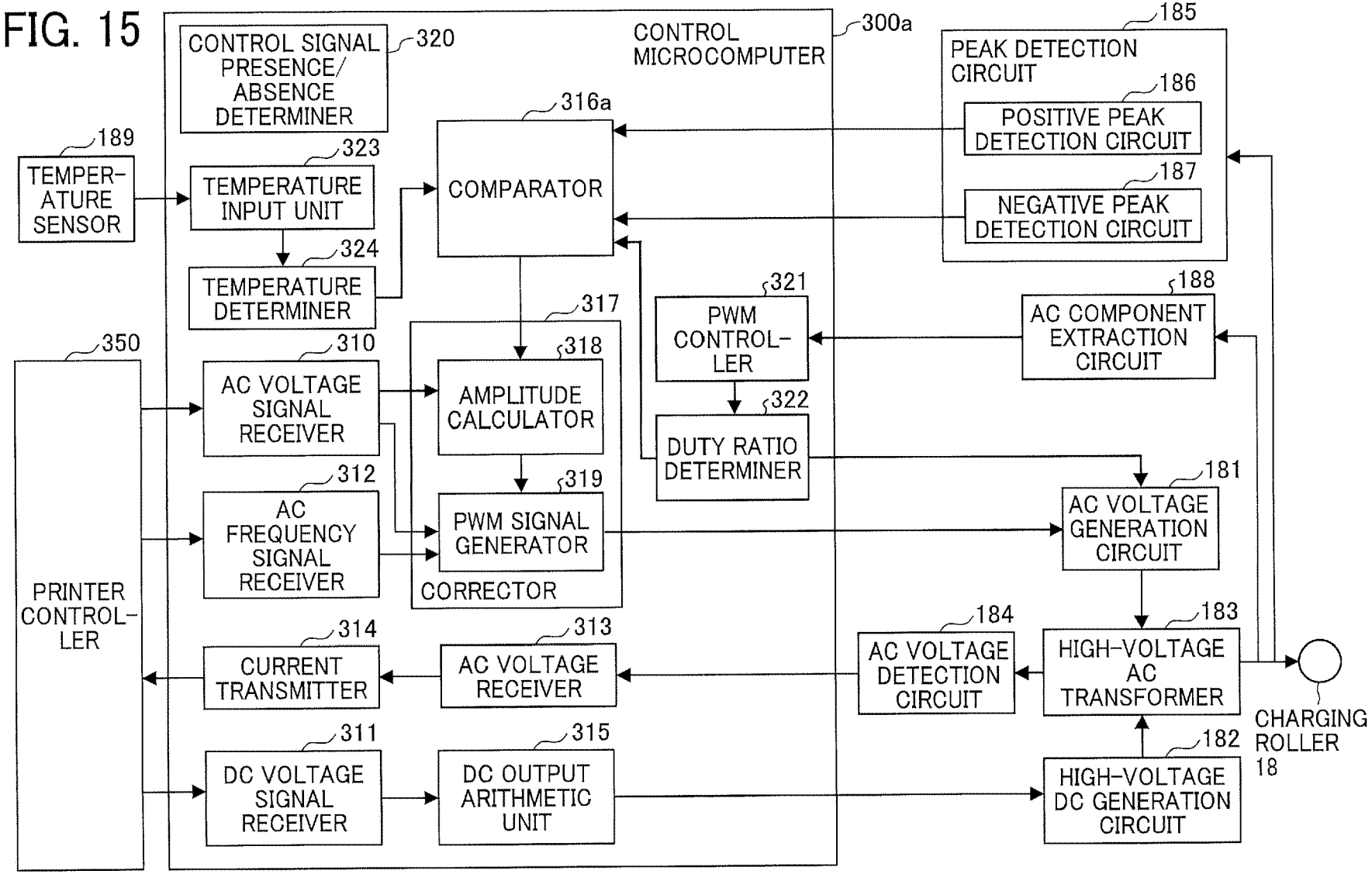
FIG. 15 is a functional block diagram illustrating an example of components of a control microcomputer according to the second embodiment.

FIG. 15 is a functional block diagram illustrating an example of components of a control microcomputer 300*a* according to the present embodiment. The control microcomputer 300*a* includes a PWM controller 321, a duty ratio determiner 322, a temperature input unit 323, and a temperature determiner 324. The PWM controller 321 is electrically connected to an AC component extraction circuit 188, the duty ratio determiner 322 is electrically connected to the AC voltage generation circuit 181, and the temperature input unit 323 is electrically connected to a temperature sensor 189.

The AC component extraction circuit 188 removes a DC component from the charging bias applied from the high-voltage AC transformer 183 to the charging roller 18, and extracts only a voltage of an AC component. The AC component extraction circuit 188 includes, for example, a voltage dividing circuit and a capacitor. The AC component extraction circuit 188 is an example of "AC component extraction means" described in the claims.

The PWM controller 321 receives an AC component voltage from the AC component extraction circuit 188. The PWM controller 321 time-divides the voltage of the input AC component, and compares a voltage value obtained by converting the voltage of the AC component with the ideal voltage value in each time-divided period. As a result of comparison, a difference between the converted voltage value and the ideal voltage value is obtained in an AC voltage distortion generation period in which the converted voltage value and the ideal voltage value are different from each other.

A PWM signal in which the duty ratio of the PWM signal in the period following the AC voltage distortion generation period is adjusted according to the obtained difference is generated, and the PWM signal and the duty ratio are output to the duty ratio determiner 322. For details of the PWM control by the PWM controller 321, see Japanese Patent No. 4444556. The PWM controller 321 is an example of "PWM control means" described in the claims.

When a desired PWM signal can be generated only by a pulse wave having a duty ratio less than 100%, the duty ratio determiner 322 outputs the input PWM signal to the AC voltage generation circuit 181. On the other hand, when a desired PWM signal cannot be generated only by a pulse wave having a duty ratio less than 100%, a signal indicating that the PWM control is not executed is transmitted to the comparator 316*a*. The duty ratio determiner 322 is an example of "duty ratio determination means" described in the claims.

The temperature input unit 323 receives temperature data detected by the temperature sensor 189 provided inside or outside the image forming apparatus and outputs the temperature data to the temperature determiner 324. The temperature sensor 189 is an example of "temperature detection means" described in the claims.

When the input temperature data is equal to or less than a predetermined threshold value, the temperature determiner 324 transmits to the comparator 316*a* a signal indicating that the PWM control is not executed. When the temperature inside or outside the image forming apparatus decreases, the temperature around the high-voltage power source 180 for charging decreases. Therefore, there is an increase in the number of cases where the state is not improved even if the present embodiment is carried out, due to a decrease in the output efficiency of the voltage by the charging high-voltage power source 180 and a change in the impedance of the load such as the photoconductor drum 40. Therefore, in this embodiment, the PWM control is not executed when the input temperature data is equal to or less than a predetermined threshold value. The temperature determiner 324 is an example of "temperature determination means" described in the claims.

A temperature threshold value is predetermined and stored in the ROM 302 or the RAM 303. The temperature determiner 324 can obtain a temperature threshold value by referring to the ROM 302 or the RAM 303. The threshold value may be different between a case where the temperature sensor 189 is provided inside the image forming apparatus and a case where the temperature sensor 189 is provided outside the image forming apparatus.

Note that that it is also possible to determine whether or not the PWM control can be executed according to only the duty ratio, regardless of the temperature.

When receiving a signal indicating that the PWM control is not to be executed, the comparator 316*a* executes the processing described in the first embodiment. The processing or operation executed by the corrector 317 or the like according to the output of the comparator 316*a* is the same as the processing or operation described in the first embodiment.

As described above, according to the present embodiment, when a desired PWM signal can be generated only by a pulse wave having a duty ratio less than 100%, distortion of the AC voltage is corrected by the PWM control. When a desired PWM signal cannot be generated only by a pulse wave having the duty ratio less than 100%, distortion of the AC voltage is corrected by the method described in the first embodiment.

Accordingly, when a desired PWM signal cannot be generated only by the pulse wave having the duty ratio less than 100%, the surface potential of the photoconductor drum 40 can be stabilized without using the charging high-voltage power source 180 having a large output capacity. Furthermore, by determining whether or not the PWM control can be executed according to an output from the temperature sensor 189 provided inside or outside the image forming apparatus, when the peripheral temperature of the charging high-voltage power source 180 becomes low, the surface potential of the photoconductor drum 40 can be stabilized without using the charging high-voltage power source 180 having a large output capacity.

In the above description, the AC component extraction circuit 188 is provided for extracting the AC component of the charging bias, but the AC component may be extracted by the peak detection circuit 185. In this case, the AC component extraction circuit 188 is not required.

The other advantages are the same as those described in the first embodiment.

Third Embodiment

Next, an example of an image forming apparatus according to a third embodiment will be described. Note that, in the first to second embodiments, description of the same components as those of the embodiment already described may be omitted.

Figure 16:
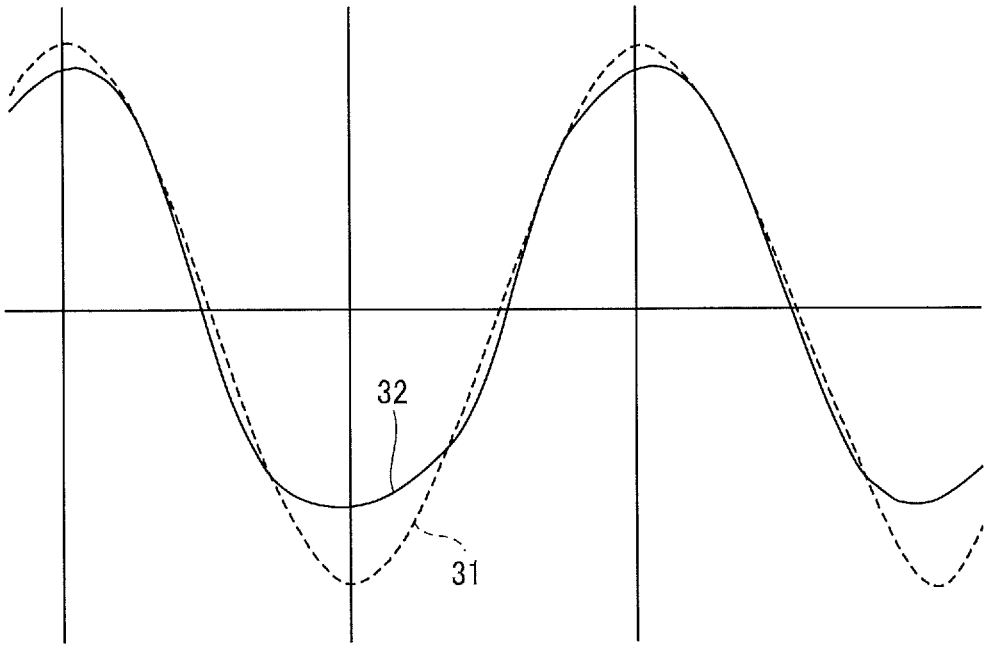
FIG. 16 is a view illustrating distortion of a shape of an AC voltage waveform.

FIG. 16 is a view illustrating distortion of a shape of an AC voltage waveform. As in FIG. 3 and the like, a horizontal axis represents time, and the ideal waveform 31 and the actual waveform 32 are illustrated. In the first and the second embodiments, the case where the positive peak value and the negative peak value are different from each other due to distortion of the AC voltage waveform has been described. However, FIG. 16 illustrates an example of distortion in which the waveform shape of the actual waveform 32 is asymmetric on the right and left sides. When the shape of the AC voltage waveform becomes asymmetric on the right and left sides, the shape of the voltage waveform may not be symmetrical between the positive side and the negative side only by causing the absolute values of the peak value to coincide with each other, and the surface potential of the charged photoconductor drum 40 may include a gradient component or the like in some cases.

In the present embodiment, voltage waveform data is generated from the voltage of the AC component extracted from the charging bias, and a PWM signal is generated according to the voltage waveform data, thereby removing the influence of not only the distortion of the peak value but also the distortion in which the waveform shape of the actual waveform 32 becomes asymmetric on the right and left sides.

Figure 17:
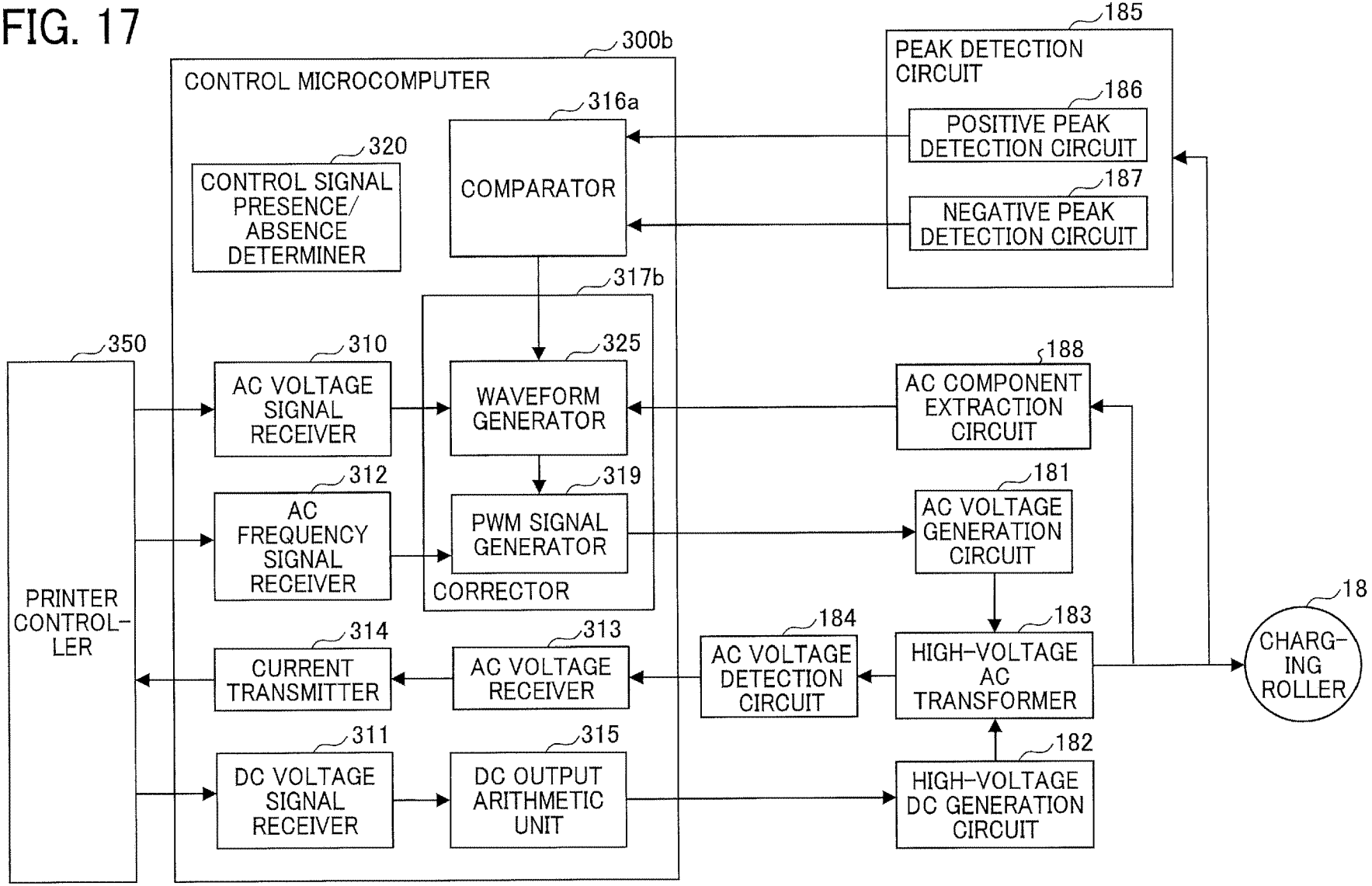
FIG. 17 is a functional block diagram illustrating an example of components of a control microcomputer according to a third embodiment.

FIG. 17 is a functional block diagram illustrating an example of components of a control microcomputer **300*b* according to the present embodiment. The control microcomputer 300*b* has a waveform generator 325, and the waveform generator 325 is electrically connected to the AC component extraction circuit 188**.

The waveform generator 325 receives a voltage value of the AC component from the AC component extraction circuit 188, performs A/D conversion, and acquires digital data of the voltage waveform. Furthermore, the waveform generator 325 receives from the comparator 316 a result obtained by comparing magnitude of the absolute value of the positive peak value of the AC voltage with magnitude of the absolute value of the negative peak value of the AC voltage.

When the absolute value of the positive peak value is smaller, the waveform generator 325 generates voltage waveform data by using data on the positive side among the acquired digital data of the voltage waveform. For example, data on the negative side is obtained by multiplying the data on the positive side by −1 and converting a sign of + into −, and this data on the negative side is replaced with data on the negative side of the digital data of the acquired voltage waveform to generate voltage waveform data.

On the other hand, when the absolute value of the negative peak value is smaller, the waveform generator 325 generates voltage waveform data by using the negative data among the acquired digital data of the voltage waveform. For example, data on the positive side is obtained by multiplying data on the negative side by −1 and converting a sign of + into −, and the data on the positive side is replaced with data on the positive side of the digital data of the acquired voltage waveform to generate voltage waveform data.

The voltage waveform data thus generated is input to the PWM signal generator 319, and is subjected to comparator processing with the carrier signal to generate a PWM signal. The amplitude and frequency of the voltage waveform data are appropriately adjusted according to a control signal input from the printer controller 350 via the AC voltage signal receiver 310 and the AC frequency signal receiver 312.

According to the present embodiment, the symmetry of the waveform shape as well as the peak value is matched on the positive side and the negative side of the AC voltage. As a result, a uniform and stable surface potential can be obtained by removing the gradient component of the surface potential of the charged photoconductor drum 40.

Other advantages are the same as those described in the first to second embodiments. Furthermore, a PWM control may also be used as described in the second embodiment. For example, when a PWM signal can be generated only by a pulse wave having a duty ratio less than 100%, distortion of the AC voltage is corrected by the PWM control. When a desired PWM signal cannot be generated only by a pulse wave having the duty ratio less than 100%, distortion of the AC voltage is corrected by the method described in the present embodiment.

Fourth Embodiment

Next, an example of an image forming apparatus according to a fourth embodiment will be described. Note that, in the first to third embodiments, description of the same components as those of the embodiment already described may be omitted.

In the present embodiment, a positive voltage waveform associated with the absolute value of the positive peak value and a negative voltage waveform associated with the absolute value of the negative peak value are obtained in advance by experiment or the like and are stored in a memory. According to the positive or negative peak value of the detected AC voltage, the positive or negative voltage waveform is acquired by referring to the memory, and voltage waveform data is generated.

An AC voltage waveform is generated using this generated voltage waveform data, thereby removing the influence of not only the distortion of the peak value but also the distortion in which the waveform shape of the actual waveform 32 becomes asymmetric on the right and left sides. While the positive or negative voltage waveform is extracted by the AC component extraction circuit 188 in the third embodiment, the present embodiment is different from the third embodiment in that the positive or negative voltage waveform is acquired from the memory.

Figure 18:
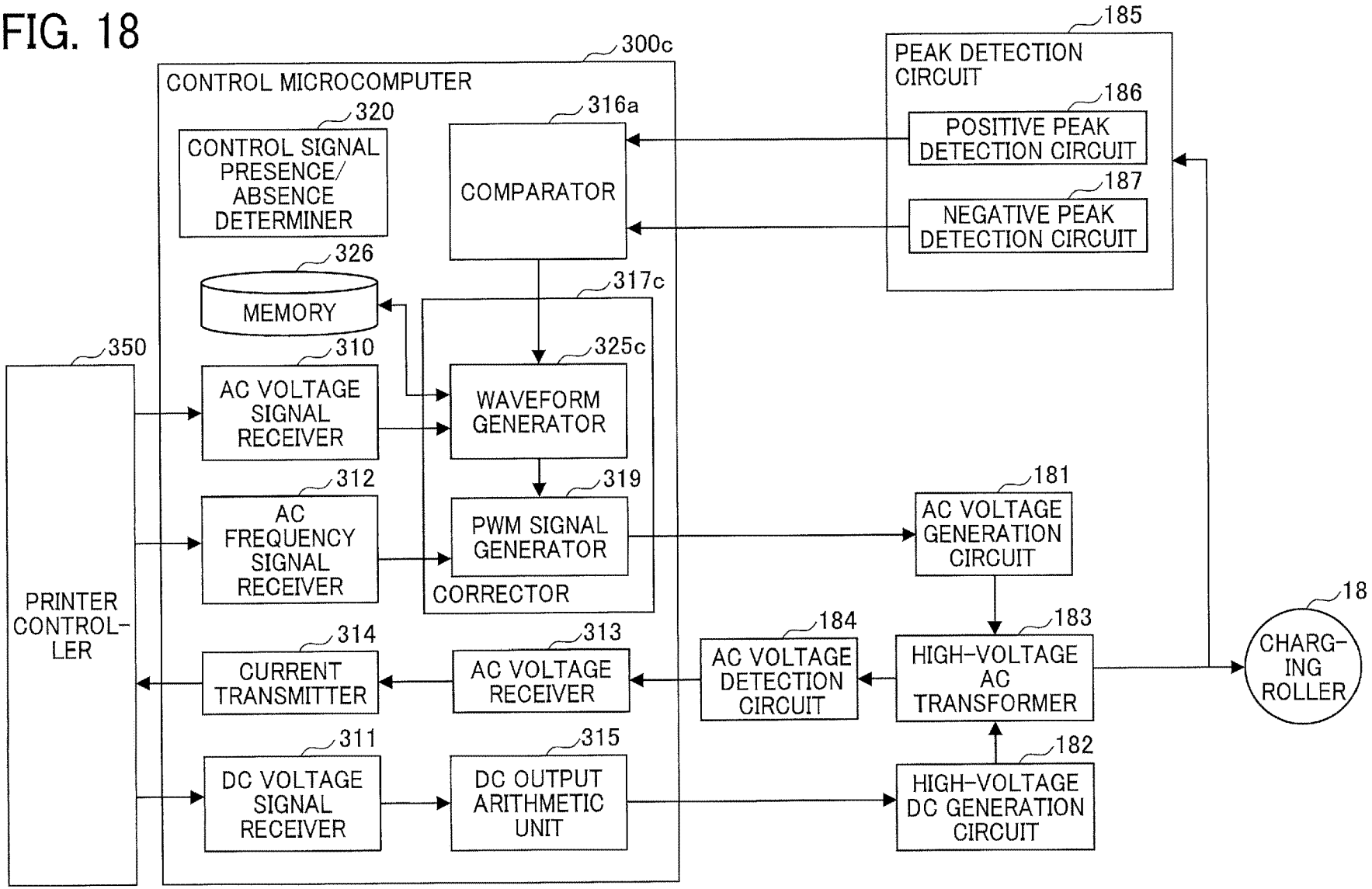
FIG. 18 is a functional block diagram illustrating an example of components of a control microcomputer according to a fourth embodiment.

FIG. 18 is a functional block diagram illustrating an example of components of a control microcomputer 300*c* according to the present embodiment. The control microcomputer 300*c* includes a waveform generator 325*c* and a memory 326. The memory 326 is implemented by the ROM 302 or the RAM 303. The memory 326 is an example of "storage means" described in the claims.

The waveform generator 325*c* receives from the comparator 316 a result obtained by comparing magnitude of the absolute value of the positive peak value of the AC voltage with magnitude of the absolute value of the negative peak value of the AC voltage.

When the absolute value of the positive peak value is smaller, the waveform generator 325*c* refers to the memory 326 to acquire a positive voltage waveform based on the positive peak value, and generates voltage waveform data according to the acquired positive voltage waveform. For example, a negative voltage waveform is obtained by multiplying the positive voltage waveform obtained by referring to the memory 326 by −1 to convert a sign of + into −, and this negative voltage waveform is combined with the positive voltage waveform to generate voltage waveform data.

On the other hand, when the absolute value of the negative peak value is smaller, the waveform generator 325*c* refers to the memory 326 to acquire a negative voltage waveform based on the negative peak value, and generates voltage waveform data according to the acquired negative voltage waveform. For example, a positive voltage waveform is obtained by multiplying the negative voltage waveform obtained by referring to the memory 326 by −1 to convert a sign of + into −, and the positive voltage waveform is combined with the negative voltage waveform to generate voltage waveform data.

The voltage waveform data thus generated is input to the PWM signal generator 319, and is subjected to comparator processing with the carrier signal. Thus, a PWM signal is generated. The amplitude and frequency of the voltage waveform data are appropriately adjusted according to a control signal input from the printer controller 350 via the AC voltage signal receiver 310 and the AC frequency signal receiver 312.

According to the present embodiment, the symmetry of the waveform shape as well as the peak value is matched on the positive side and the negative side of the AC voltage. As a result, a uniform and stable surface potential can be obtained by removing the gradient component of the surface potential of the charged photoconductor drum 40.

Other advantages are the same as those described in the first to third embodiments. Furthermore, a PWM control may also be used as described in the second embodiment. For example, when a PWM signal can be generated only by a pulse wave having a duty ratio less than 100%, distortion of the AC voltage is corrected by the PWM control. When a desired PWM signal cannot be generated only by a pulse wave having the duty ratio less than 100%, distortion of the AC voltage is corrected by the method described in the present embodiment.

Although the image forming apparatus and the image forming method according to the embodiment have been described above, embodiments of the present disclosure are not limited to the above-described embodiments, and various modifications and improvements are possible within the scope of the present disclosure.

The above-described embodiments are illustrative and do not limit the present disclosure. Thus, numerous additional modifications and variations are possible in light of the above teachings. For example, elements and/or features of different illustrative embodiments may be combined with each other and/or substituted for each other within the scope of the present disclosure.

Any one of the above-described operations may be performed in various other ways, for example, in an order different from the one described above.

Each of the functions of the described embodiments may be implemented by one or more processing circuits or circuitry. Processing circuitry includes a programmed processor, as a processor includes circuitry. A processing circuit also includes devices such as an application specific integrated circuit (ASIC), digital signal processor (DSP), field programmable gate array (FPGA), and conventional circuit components arranged to perform the recited functions.

The invention claimed is:

1. An image forming apparatus comprising:

an image bearer;

a charger configured to charge the image bearer; and a power source configured to apply to the charger a charging bias obtained by superimposing an alternating current (AC) voltage on a direct current (DC) voltage, wherein the power source includes:

a peak detection circuit configured to detect a positive peak value and a negative peak value of a voltage of an AC component of the charging bias, and control circuitry configured to control the AC voltage; and the control circuitry is configured to:

determine which one of an absolute value of the positive peak value and an absolute value of the negative peak value is smaller by comparing the absolute value of the positive peak value with the absolute value of the negative peak value, correct the AC voltage to cause the absolute value of the negative peak value to decrease and match the absolute value of the positive peak value when the absolute value of the positive peak value is smaller than the absolute value of the negative peak value, and correct the AC voltage to cause the absolute value of the positive peak value to decrease and match the absolute value of the negative peak value when the absolute value of the negative peak value is smaller than the absolute value of the positive peak value.

2. The image forming apparatus according to claim 1, wherein the power source includes an AC voltage generation circuit configured to generate the AC voltage according to a pulse width modulation signal, and wherein the control circuitry is configured to:

generate the pulse width modulation signal from a sine wave having an amplitude based on the positive peak value when the absolute value of the positive peak value is smaller than the absolute value of the negative peak value; and generate the pulse width modulation signal from a sine wave having an amplitude based on the negative peak value when the absolute value of the negative peak value is smaller than the absolute value of the positive peak value.

3. The image forming apparatus according to claim 1, wherein the power source includes:

an AC voltage generation circuit configured to generate the AC voltage according to a pulse width modulation signal; and an AC component extraction circuit to extract a voltage of an AC component of the charging bias, and wherein the control circuitry is configured to:

generate the pulse width modulation signal from a positive voltage waveform of the voltage of the AC component extracted by the AC component extraction circuit, when the absolute value of the positive peak value is smaller than the absolute value of the negative peak value; and generate the pulse width modulation signal from a negative voltage waveform of the voltage of the AC component extracted by the AC component extraction circuit, when the absolute value of the negative peak value is smaller than the absolute value of the positive peak value.

4. The image forming apparatus according to claim 1, wherein the power source includes an AC voltage generation circuit configured to generate the AC voltage according to a pulse width modulation signal, wherein the control circuitry includes a memory configured to store a positive voltage waveform associated with the absolute value of the positive peak value detected by the peak detection circuit and a negative voltage waveform associated with the absolute value of the negative peak value detected by the peak detection circuit, and wherein the control circuitry is configured to:

generate the pulse width modulation signal from the positive voltage waveform acquired by referring to the memory according to the absolute value of the positive peak value when the absolute value of the positive peak value is smaller than the absolute value of the negative peak value; and generate the pulse width modulation signal from the negative voltage waveform acquired by referring to the memory according to the absolute value of the negative peak value when the absolute value of the negative peak value is smaller than the absolute value of the positive peak value.

5. The image forming apparatus according to claim 1, wherein the power source includes:

an AC voltage generation circuit configured to generate the AC voltage according to a pulse width modulation signal; and an AC component extraction circuit configured to extract a voltage of an AC component of the charging bias, and wherein the control circuitry is configured to:

compare a converted voltage value obtained by converting the voltage of the AC component with an ideal voltage value in each period obtained by time-dividing the voltage of the AC component;

obtain a difference between the converted voltage value and the ideal voltage value in an AC voltage distortion generation period in which the converted voltage value and the ideal voltage value are different from each other;

adjust a duty ratio of a pulse width modulation (PWM) signal in a period following the AC voltage distortion generation period according to the difference obtained, to perform PWM control on the AC voltage; and determine whether the PWM control is executable based on the duty ratio.

6. The image forming apparatus according to claim 5, further comprising a temperature sensor configured to detect a temperature inside or outside the image forming apparatus, wherein the control circuitry is configured to determine whether the PWM control is executable based on the temperature detected by the temperature sensor.

7. The image forming apparatus according to claim 1, wherein the positive peak value is a positive effective value and the negative peak value is a negative effective value.

8. An image forming apparatus comprising:

an image bearer;

a charger configured to charge the image bearer; and a power source configured to apply to the charger a charging bias obtained by superimposing an alternating current (AC) voltage on a direct current (DC) voltage, wherein the power source includes:

peak detection means for detecting a positive peak value and a negative peak value of a voltage of an AC component of the charging bias, and control means for controlling the AC voltage; and the control means includes:

comparison means for determining which one of an absolute value of the positive peak value and an absolute value of the negative peak value is smaller by comparing the absolute value of the positive peak value with the absolute value of the negative peak value, and correction means for correcting the AC voltage to cause the absolute value of the negative peak value to decrease and match the absolute value of the positive peak value when the absolute value of the positive peak value is smaller than the absolute value of the negative peak value, and correcting the AC voltage to cause the absolute value of the positive peak value to decrease and match the absolute value of the negative peak value when the absolute value of the negative peak value is smaller than the absolute value of the positive peak value.

9. The image forming apparatus according to claim 8, wherein the power source includes AC voltage generation means for generating the AC voltage according to a pulse width modulation signal, and wherein the correction means generates the pulse width modulation signal from a sine wave having an amplitude based on the positive peak value when the absolute value of the positive peak value is smaller than the absolute value of the negative peak value, and generates the pulse width modulation signal from a sine wave having an amplitude based on the negative peak value when the absolute value of the negative peak value is smaller than the absolute value of the positive peak value.

10. The image forming apparatus according to claim 8, wherein the power source includes:

AC voltage generation means for generating the AC voltage according to a pulse width modulation signal; and AC component extraction means for extracting a voltage of an AC component of the charging bias, and wherein the correction means generates the pulse width modulation signal from a positive voltage waveform of the voltage of the AC component extracted by the AC component extraction means, when the absolute value of the positive peak value is smaller than the absolute value of the negative peak value, and generates the pulse width modulation signal from a negative voltage waveform of the voltage of the AC component extracted by the AC component extraction means, when the absolute value of the negative peak value is smaller than the absolute value of the positive peak value.

11. The image forming apparatus according to claim 8, wherein the power source includes AC voltage generation means for generating the AC voltage according to a pulse width modulation signal, wherein the control means includes storage means for storing a positive voltage waveform associated with the absolute value of the positive peak value detected by the peak detection means and a negative voltage waveform associated with the absolute value of the negative peak value detected by the peak detection means, and wherein the correction means generates the pulse width modulation signal from the positive voltage waveform acquired by referring to the storage means according to the absolute value of the positive peak value when the absolute value of the positive peak value is smaller than the absolute value of the negative peak value, and generates the pulse width modulation signal from the negative voltage waveform acquired by referring to the storage means according to the absolute value of the negative peak value when the absolute value of the negative peak value is smaller than the absolute value of the positive peak value.

12. The image forming apparatus according to claim 8, wherein the power source includes:

AC voltage generation means for generating the AC voltage according to a pulse width modulation signal; and AC component extraction means for extracting a voltage of an AC component of the charging bias, and wherein the control means includes:

PWM control means for:

comparing a converted voltage value obtained by converting the voltage of the AC component with an ideal voltage value in each period obtained by time-dividing the voltage of the AC component;

obtaining a difference between the converted voltage value and the ideal voltage value in an AC voltage distortion generation period in which the converted voltage value and the ideal voltage value are different from each other; and adjusting a duty ratio of a pulse width modulation (PWM) signal in a period following the AC voltage distortion generation period according to the difference obtained, to perform PWM control on the AC voltage; and duty ratio determination means for determining whether the PWM control is executable based on the duty ratio.

13. The image forming apparatus according to claim 12, further comprising temperature detection means for detecting a temperature inside or outside the image forming apparatus, wherein the control means includes temperature determination means for determining whether the PWM control is executable based on the temperature detected by the temperature detection means.

14. The image forming apparatus according to claim 8, wherein the positive peak value is a positive effective value and the negative peak value is a negative effective value.

15. An image forming method to be executed by an image forming apparatus comprising an image bearer, a charger configured to charge the image bearer, and a power source configured to apply to the charger a charging bias obtained by superimposing an alternating current (AC) voltage on a direct current (DC) voltage, the image forming method comprising:

detecting a positive peak value and a negative peak value of a voltage of an AC component of the charging bias;

determining which one of an absolute value of the positive peak value and an absolute value of the negative peak value is smaller by comparing the absolute value of the positive peak value with the absolute value of the negative peak value;

correcting the AC voltage to cause the absolute value of the negative peak value to decrease and match the absolute value of the positive peak value when the absolute value of the positive peak value is smaller than the absolute value of the negative peak value; and correcting the AC voltage to cause the absolute value of the positive peak value to decrease and match the absolute value of the negative peak value when the absolute value of the negative peak value is smaller than the absolute value of the positive peak value.

* * * * *